US005322473A

United States Patent [19]

Hofstra et al.

[11] Patent Number: 5,322,473

[45] Date of Patent: Jun. 21, 1994

[54] MODULAR WALL APPARATUS AND METHOD FOR ITS USE

[75] Inventors: Joseph S. Hofstra, Los Lunas; Ronald J. Karaskiewicz; Mark R. Fischer, both of Albuquerque, all of N. Mex.

[73] Assignee: Quality Air Systems, Inc., Albuquerque, N. Mex.

[21] Appl. No.: 956,037

[22] Filed: Oct. 2, 1992

Related U.S. Application Data

[63] Continuation-in-part of Ser. No. 790,654, Nov. 8, 1991, Pat. No. 5,181,883, which is a continuation-in-part of Ser. No. 525,327, May 17, 1990, Pat. No. 5,085,134.

[51] Int. Cl.[5] ..... F24F 7/10

[52] U.S. Cl. ..... 454/186; 454/230; 454/306

[58] Field of Search ..... 454/185, 186, 230, 231, 454/233, 234, 236, 306

[56] References Cited

U.S. PATENT DOCUMENTS

| | | | |
|---|---|---|---|
| 1,274,914 | 8/1918 | McDevitt . | |
| 1,948,755 | 2/1934 | Gullicksen . | |
| 2,155,495 | 4/1939 | Kuntz . | |
| 2,369,375 | 2/1945 | Sonntag . | |
| 2,507,634 | 5/1950 | Hill | 454/231 |
| 2,549,042 | 4/1951 | Angermueller . | |
| 3,204,545 | 9/1965 | Benson . | |
| 3,427,768 | 2/1969 | Fulton | 52/36 |
| 3,789,747 | 2/1974 | Wasserman et al. | 454/186 |
| 4,043,776 | 8/1977 | Orel | 55/385 |
| 4,105,015 | 8/1978 | Isom | 126/299 |
| 4,177,045 | 12/1979 | Orel | 55/102 |
| 4,244,710 | 1/1981 | Burger | 55/6 |
| 4,248,162 | 2/1981 | Skeist | 108/50 |
| 4,261,712 | 4/1981 | Kinkade | 55/126 |
| 4,378,727 | 4/1983 | Doss . | |
| 4,440,342 | 4/1984 | Flagg | 237/50 |
| 4,571,898 | 2/1986 | Le Cacheux et al. | 52/36 |
| 4,623,367 | 11/1986 | Paulson . | |
| 4,625,633 | 12/1986 | Martin . | |
| 4,646,966 | 3/1987 | Nussbaum | 237/49 |
| 4,666,478 | 5/1987 | Boissinot et al. | 55/279 |
| 4,733,507 | 3/1988 | Doublet | 52/63 |
| 4,773,309 | 9/1988 | Walters . | |
| 4,784,445 | 11/1988 | Ott | 454/233 X |
| 4,854,949 | 8/1989 | Giles, Sr. et al. | 55/126 |
| 4,974,915 | 12/1990 | Bussard | 312/236 |
| 5,065,832 | 11/1991 | Mark | 108/60 |
| 5,085,134 | 2/1992 | Hofstra et al. | 454/67 |
| 5,135,436 | 8/1992 | Levy et al. | 454/306 |

FOREIGN PATENT DOCUMENTS

| | | | |
|---|---|---|---|
| 968113 | 5/1975 | Canada | 52/36 |
| 2632722 | 2/1977 | Fed. Rep. of Germany | 454/306 |
| 2259964 | 8/1975 | France | 52/36 |
| 55-112951 | 9/1980 | Japan . | |
| 197941 | 9/1986 | Japan | 454/233 |
| 204050 | 8/1988 | Japan | 454/230 |
| 1-118049 | 5/1989 | Japan . | |

*Primary Examiner*—Harold Joyce

*Attorney, Agent, or Firm*—Deborah A. Peacock, Rod D. Baker; Dennis F. Armijo

[57] ABSTRACT

A smoker's booth for isolating, containing, venting, and filtering tobacco smoke. The booth has a walled enclosure with a modular room divider system using hollow walls, filtration, and blower devices to remove tobacco smoke from workplace air.

69 Claims, 16 Drawing Sheets

MODULAR WALL APPARATUS AND METHOD FOR ITS USE

CROSS-REFERENCE TO RELATED APPLICATIONS

This application is a continuation-in-part application of U.S. patent application Ser. No. 07/790,654, entitled Smoker's Booth to Hofstra, et al., filed on Nov. 8, 1991 U.S. Pat. No. 5,181,883, which is a continuation-in-part application of U.S. Pat. No. 5,085,134 (Ser. No. 07/525,327), entitled Smoker's Booth, to Hofstra, et al., the teachings of which are incorporated herein by reference.

BACKGROUND OF THE INVENTION

1. Field of the Invention (Technical Field)

The present invention relates to a wrap-around enclosure or booth as a "designated smoking area" within public or private facilities or outdoors suitable for one or more smokers that isolates, contains, vents and/or filters tobacco smoke. This invention makes it possible for smokers to enjoy a cigarette, cigar, or pipe in public or private buildings or out-of-doors without contaminating the air for non-smokers in the vicinity. This invention also relates to a modular office system and method, whereby one or more office or workshop areas are defined by an assembly of walls, couplers and fan/-filtration stations. Ambient air containing tobacco smoke or other pollutants is drawn through duct-like walls, filtered, and returned to the office areas, thus allowing smokers to work in the vicinity of non-smokers without tobacco smoke irritations.

There are four major issues concerning tobacco smoke or smoking: health, productivity, social conflict, and legal compliance/liability. The health effects of primary and secondary smoke include allergies, asthma, emphysema, and increased incidence of lung cancer. There is growing evidence that non-smokers have shown decreased general health in the presence of secondary smoke. Productivity is reduced for smoking employees by at least the amount of time spent smoking and traveling to and from permitted smoking areas. In facilities that have been declared totally non-smoking, the time required to travel from the work location to the outside and back again can be significant. Encounters between smokers and non-smokers are becoming more confrontational and divisive. Local ordinances prohibiting smoking in public buildings, except in designated smoking areas, create a legal obligation for facility owners and managers. Liability arising from smoke related illnesses, or perceived civil rights violations could result in potentially disastrous financial consequences.

Modifications to existing public buildings and facilities, or out-of-doors, to create designated smoking areas that effectively contain and filter tobacco smoke for large numbers of people are difficult and expensive. In all known facilities, such designated smoking areas segregate the population physically into rooms containing either smokers or nonsmokers and do not allow the two groups to commingle in a common area.

Thus, the need exists to provide an isolated smoker's booth or kiosk, which is inexpensive and useful in high traffic areas.

The need also exists for a means and method of integrating smoke evacuation and filtration systems into the office or workshop workplace, thereby permitting smokers to work in the immediate vicinity of non-smokers without undue isolation of either.

2. Background Art

Various types of booths, enclosures, and tobacco smoke containment and/or filtering devices are already known. Each varies significantly from the present invention.

Canadian Patent No. 968,113, to Anon, entitled Telephone Booth, is intended for use solely as a telephone booth and not as a smoker's booth. It does not contain an ashtray, venting, or air filtration system. The size of the enclosure appears incapable of containing the volume of tobacco smoke that is usually produced by a cigarette, cigar, or pipe. The sides of the booth are perforated to allow the air within the booth to exchange freely with the air outside the booth. Thus, this device would not satisfy the obvious requirements of an isolated smoke containment booth.

U.S. Pat. No. 4,733,507, to Doublet, entitled Isolation Hut, teaches a temporary booth made principally of cardboard and useful as a polling booth, not as a smoker's booth. The device contains no air handling, venting, or filtration equipment. Its flammable construction material, lack of an ashtray or fireproof container and non-durable design make it inappropriate as a smoker's booth. Further, its use of floor space makes it unsuitable for high pedestrian traffic areas like the hallways of large public buildings or airport concourses.

U.S. Pat. No. 3,427,768, to Fulton, entitled Booth with a Rotatable Door and Seat, discloses a booth suitable as a telephone booth and not for isolating tobacco smoke. The device does not contain an air movement, venting, or filtration system or an ashtray. When closed, it would trap tobacco smoke created by a cigarette, cigar, or pipe, but would not remove this smoke from the air or prevent it from escaping when the door was opened.

U.S. Pat. No. 4,571,898, to Le Cacheux, et al., entitled Sales Boutique, Especially a Newspaper Kiosk, is designed to be located outdoors and serve as a facility that exhibits and sells small items such as newspapers or magazines, not to isolate or contain smoke. It does not contain air handling, venting, or filtering equipment or ashtrays for smokers.

French Patent No. 74 03884, to More, entitled Habitacle de café, discloses an enclosed circular seating area, a round centrally located table, ceiling lighting, and a floor heating duct. It is designed to be placed outside a café to offer shelter in all weather to customers, and not as a smoker's enclosure. This invention does not contain air handling, venting, or filtration equipment to clean and remove smoke generated within the enclosure. The size and design of the enclosure would not make it appropriate for use as a smoker's booth. It is not suited to the requirements of public facilities that must handle potentially large numbers of smokers within existing floor space and traffic flow requirements.

The device disclosed in U.S. Pat. No. 4,623,367, to Paulson, entitled Smoke-Free Work Area, is shaped like an umbrella covered patio table or a work desk with a hood. These devices are most appropriate for offices or restaurants that have limited traffic flow and sufficient floor space to permit their use by smokers who will remain in the area for an extended period of time. The smokers must be seated and face toward the center of the table for the smoke to be captured by the air handling system. This invention and its embodiments would not be appropriate for high traffic areas, such as hallways or airport concourses. The Paulson device relies on a relatively calm air environment to effectively contain the smoke within the filtering volume of its air handling system. It is not suited to the requirements of public facilities that must handle potentially large numbers of smokers within existing floor space and traffic flow requirements. It does not automatically turn on and off when the smoker approaches.

Japanese Patent No. JA 0112951, to Tsujimura, entitled Illuminator, discloses a hood suspended above a table containing a cooking burner or ashtray to capture the smoke that rises in the heat of the light and vent it through the ceiling. A smoker has to remain seated at the table and face inward for the tobacco smoke to be contained by the rising air and overhead hood. This invention is most appropriate for a restaurant or other location where there is floor space suitable for tables and chairs. Modifications to the existing facility must be made to remove the smoke that is exhausted above the ceiling. The illuminator must remain on at all times for this invention to work properly because the heat generated by the incandescent bulb is required to create the updraft that moves smoke into the hood. This device does not have the air containment, movement, venting, and filtration capacity required for an isolated smoker's booth.

Japanese Patent No. JA 0118049, to Ehama, entitled Hood Device for Smoking, contains a fan and single paper filter element mounted above a chair. The device is not automatically activated when a smoker enters the area or sits in the chair. The application of this invention is limited to those locations (office and possibly restaurant) that can fix the position of a chair so that the shield screen and down-draft air curtain can be lowered to collect the tobacco smoke. The smoker must remain seated or standing under the hood for the smoke to be contained by this system. The air curtain of this invention will not effectively contain smoke in the turbulent air conditions created in high traffic areas. This invention also requires modifications to the ceiling of the facility to support the hood device.

U.S. Pat. No. 4,625,633, to Martin, entitled Ventilated Core Unit for Service Connections, U.S. Pat. No. 4,784,445, to Ott, entitled Heated and Ventilated Work Station and U.S. Pat. No. 5,065,832, to Mark, entitled Multiple Section Work Station, describe multiple work stations with circulating air from a central core or node. These devices do not circulate air through the partitions or walls of the workstations nor do they draw or exhaust air through furniture attached to the workstation.

Devices disclosed in U.S. Pat. No. 4,378,727, to Doss, entitled Data Station with Wire and Air Duct; U.S. Pat. No. 4,646,966, to Nussbaum, entitled Personalized Air Conditioning; and U.S. Pat. No. 4,773,309, to Walters, entitled Heating and Air Conditioning System Incorporating Contaminant Control are fixed location systems that are the air conditioning and ventilating system for a building. They do not disclose a portable modular system that runs independently of the main building air conditioning or ventilating unit.

U.S. Pat. No. 4,974,915, to Bussard, entitled Modular Work Station, discloses a cluster type work station with a "weather station" for circulating filtered air through the walls and out vents to the work area. A vented hood and vented base above the top and bottom of each wall unit, respectively, is not disclosed. Additionally, circulating air through customized furniture to draw contaminated air and exhaust filtered air in closer proximity to a worker is not shown.

SUMMARY OF THE INVENTION (DISCLOSURE OF THE INVENTION)

The present invention comprises a smoker's booth for receiving and accommodating one or more smokers and for isolating smokers and tobacco smoke. The smoker's booth comprises a walled enclosure, ceiling, a smoker's access aperture disposed in the walled enclosure for providing ingress and egress for the smokers, and a venting mechanism to vent tobacco smoke from the walled enclosure and away from the vicinity proximate to the walled enclosure.

In the preferred embodiment, the walled enclosure comprises side walls, preferably curved in a wrap-around shape, with the smoker's access aperture disposed between the wrap-around side walls. The walled enclosure further preferably comprises a single back wall for wall-mounting on a flat wall surface, or two back walls which meet in a corner, for wall-mounting in a corner configuration. The back wall or walls are preferably connected to the side walls. For a plurality of smoker's booths, the booths can share at least one wall. The back wall or walls are curved towards the smoker's access aperture at the ceiling to assist in smoke movement towards the vent. When the smoker's booth is wall mounted, the walled enclosure comprises partial walls disposed above the floor surface. When the smoker's booth is disposed on the floor (free standing) or floor mounted, it requires a base. The walled enclosure, particularly the side walls, may be transparent, translucent, or opaque. The walled enclosure may comprise indicia, such as advertising. The walled enclosure may further comprise a door or other closure to close the access to the smoker's booth.

Also in the preferred embodiment, the venting mechanism comprises a fan and at least one exhaust aperture disposed in the ceiling. The smoker's booth further preferably comprises an air intake aperture disposed proximate the smoker's access aperture. Also, the smoker's booth preferably further comprises a filtering system, using a particulate filter, an electrostatic filter, an activated charcoal filter, or combination thereof. The filters are removable from the smoker's booth preferably through the ceiling For a plurality of smoker's booths a common exhaust system such as a facility heating, venting, and air conditioning system, may be provided.

In the preferred embodiment, the smoker's booth further comprises a sensor for detecting the presence of a person. Sensors, useful in accordance with the invention include infrared, sonic, capacitive sensors and the like. The sensor may automatically activate the venting mechanism, filters, and the light. The sensor may have a predetermined delay for deactivating the venting (and filter and light) after the person exits the smoker's booth. The smoker's booth may further comprise a shelf, ashtray, seat (preferably a foldable seat), vending machine, rack, television, telephone, or the like.

In an alternative embodiment of the invention, apertured panel walls are conjoined using vertical coupling devices to assemble a modular office divider system. The apertured walls are hollow and sectionalized, with intake ports near their tops and exhaust ports near their bottoms. An interconnected network of two or more walls are linked by the couplers to a central air blower and filtering apparatus. The fan and filtering node is fitted with a blower fan and filter. Smoke-contaminated air is drawn by the fan into the intake port apertures of the wall components, and further pulled through the interconnected upper sections of the walls, eventually to be pulled into and cleansed by the filter in the central fan and filter node apparatus. Filtered air is returned through the interconnected lower sections of the wall components and reintroduced into the ambient air via the exhaust ports distributed along the wall bottoms.

In this alternative embodiment, the panel walls of the modular divider system are fitted with slots, vents, ports and braces to accommodate the installation of customized furnishings. Specially constructed furnishings, e.g. work desks, cabinets, shelving, comprising elements of the invention, have exhaust and inlet ports and venting integrated into their structure. The furniture vents and ducts correspond to appropriate optional access ports within the walls of the system, such that the furnishings themselves are an integral part of the air treatment and delivery system. Alternatively, certain large, free-standing furnishings, such as desks, may comprise a completely integrated air extraction, filtering and delivery system.

It is a primary object of the present invention to provide a smoker's booth, for containing and venting tobacco smoke, for use within public and private buildings or outside areas.

It is another object of the present invention to provide means to contain and filter primary and secondary tobacco smoke created when an individual smokes a cigarette, cigar or pipe.

Yet another object of the present invention is to provide an enclosure for smoking that does not interrupt normal traffic flow within public and private buildings or out-of-doors.

Still another object of the present invention is to minimize power consumption by the use of a proximity sensor.

An advantage of the present invention is the provision of a smoker's booth that can be matched with facility decor in colors and materials.

A further advantage of the present invention is its portability and ease of construction.

Still another advantage of the present invention is the provision of a method and means for permitting smokers to work in the same office environment with non-smokers without offensive tobacco smoke.

A further advantage of the present invention is the provision of a method and means for integrating an ambient air movement and filtration system into an office or workshop environment.

Other objects, advantages and novel features, and further scope of applicability of the present invention will be set forth in part in the detailed description to follow, taken in conjunction with the accompanying drawing, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention.

DETAILED DESCRIPTION OF THE PREFERRED EMBODIMENTS OF THE INVENTION (BEST MODES FOR CARRYING OUT THE INVENTION)

The present invention relates to a wrap-around enclosure, booth or kiosk having air handling, venting, and filtration devices and a proximity sensor intended to provide a containment and isolation of tobacco smoke within public and private buildings or outdoors. The present invention is suitable for areas that accommodate large numbers of people within, for example, restricted floor spaces, such as airport concourses and gate areas, convention centers, exhibit halls, sports arenas, halls within municipal buildings, court houses, manufacturing facilities, hospital waiting rooms, employee break areas, and confined courtyards. The present invention requires little or no facility modifications.

The present invention also relates to an integrated modular divider system incorporating general air-cleaning objects and advantages. A network of two or more portable, hollow, and sectionalized walls serve dual functions as room dividers and air ducts. The system may advantageously be used to partition a single office or workroom into discrete office or workshop cubicles, thus allowing smokers and non-smokers to share a common environment without suffering the adverse impacts of tobacco smoke. The modular wall units are inserted into corresponding openings in hollow, sectionalized, vertically disposed coupler units, which serve to join individual wall components and direct air flow between them. Air is moved through the wall divider network to a central fan and filter node, where it is filtered and then returned to the ambient air through the wall system.

Figure 1:
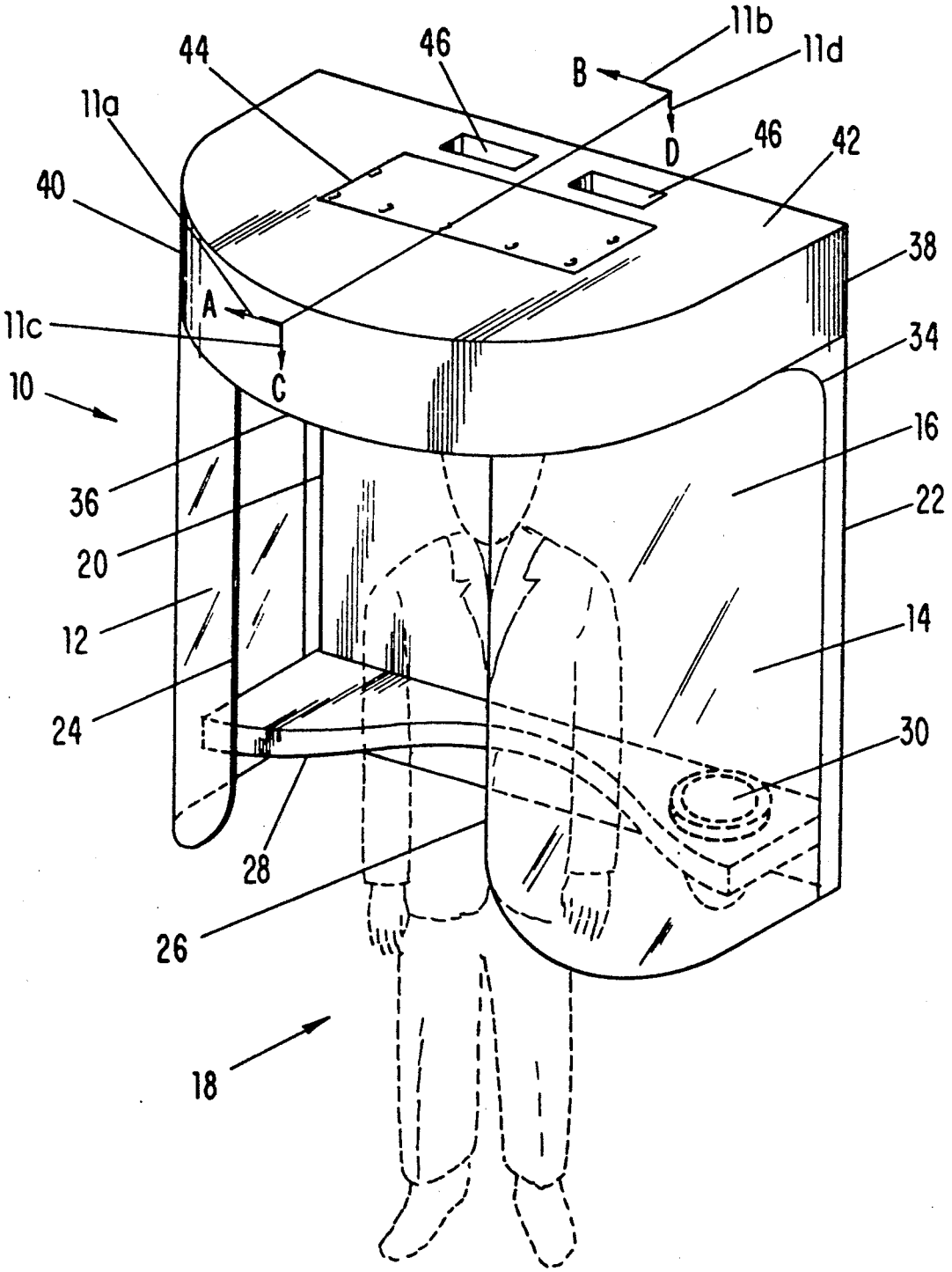
FIG. 1 is a perspective view of the preferred embodiment of the smoker's booth of the present invention.
Figure 2:
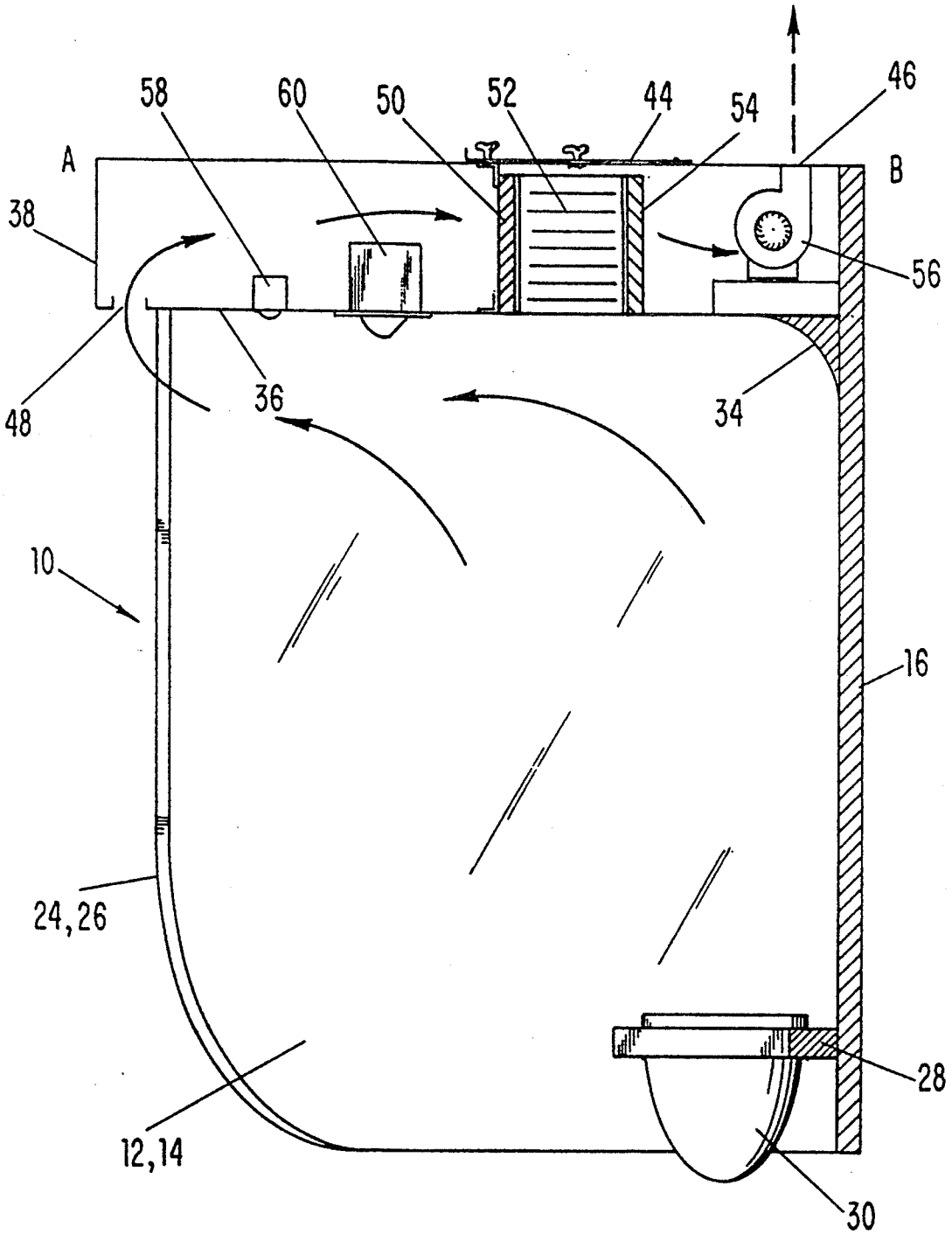
FIG. 2 is a side view of the FIG. 1 embodiment taken along the line 11*a*–11*b* showing the arrangement of the sensor, light, filters, and fan, and the movement of air and smoke when the system is activated.
Figure 3:
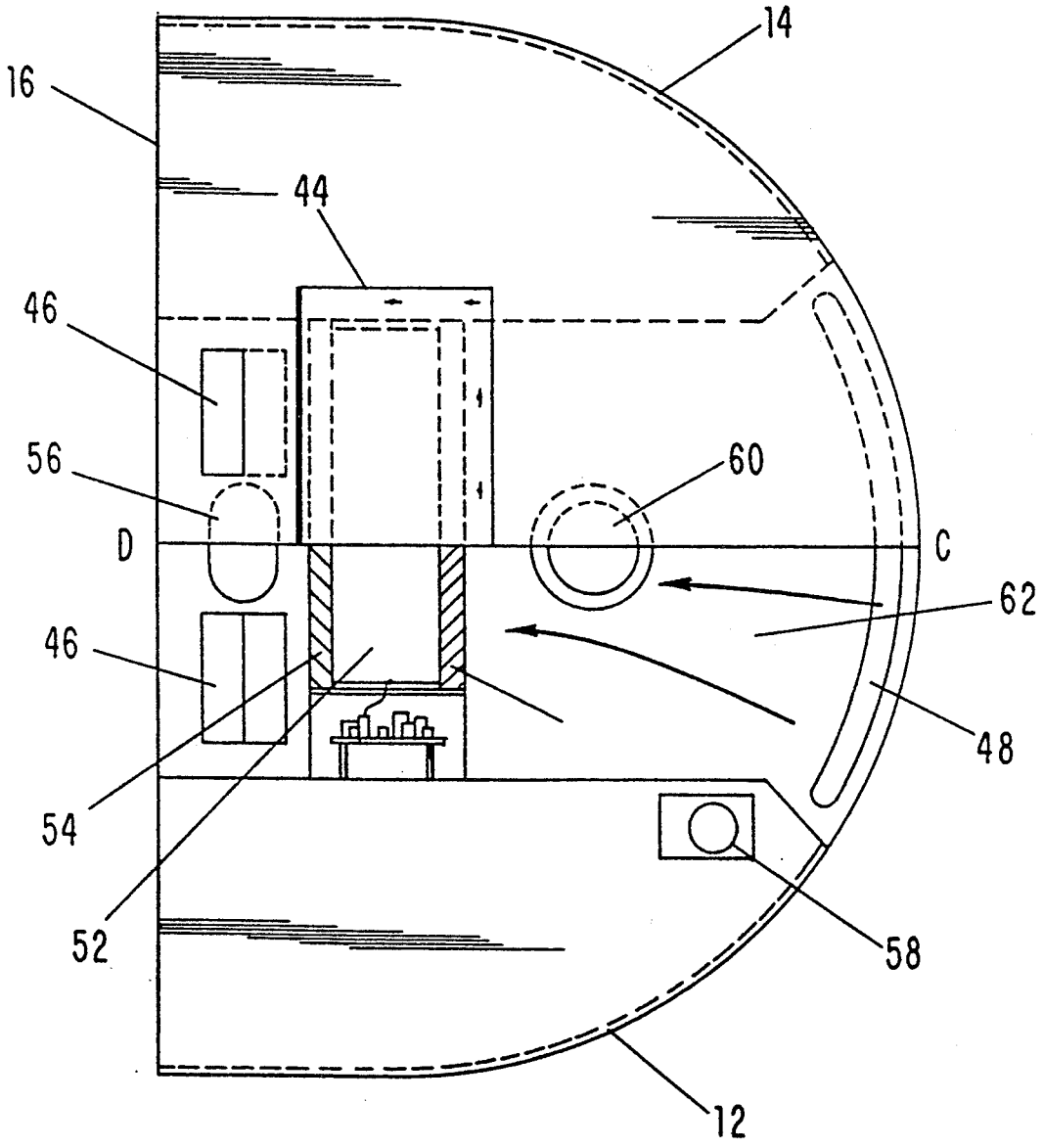
FIG. 3 is a top cutaway plan view of the FIG. 1 embodiment taken along the line 11*c*–11*d*, showing the location of the air inlet and the flow of air and smoke within the booth, and through the air plenum, filters, and fan.

Reference is now made to FIGS. 1-3, which illustrate the preferred embodiment of the invention. FIGS. 1-3 show a wall-mounted smoker's booth 10 intended for use as a contained smoking area in high traffic areas. The smoker's booth 10 may accommodate one or more smokers and comprises a walled enclosure, such as two partial side walls 12 and 14, and back wall 16, and a front smoker's access aperture 18. The rear wall 16 is flat to assist in wall mounting and is joined at each side by curved side walls 12 and 14 at vertical or corner edges 20 and 22. The smoker's booth 10 is preferably and advantageously wall-mounted at its rear wall or surface 16. The side walls 12 and 14 are curved inward along their forward segment to create a front access aperture 18 that is narrower than the width of the booth 10 in that they do not touch the floor. The front access aperture 18 is limited on each side by the forward vertical edges of the side walls 24 and 26. The partial walls 12, 14, and 16 allow for ease of cleaning around the booth 10, in that they do not touch the floor. The preferred embodiment wraps around the smoker(s) to effectively contain primary and secondary smoke and allow the air movement system to quickly clear the booth 10. The wrap-around walled enclosure of the present invention so effectively contains the smoke generated therein that a moderately sized air handling and filtration system can exchange and cleanse the entire volume of air within the booth more than twice every minute so as to maintain a clean, smoke-free environment for nonsmokers in the immediate vicinity.

In the preferred embodiment, the smoker's booth 10 further comprises a convenience shelf 28 for placing packages, purses, briefcases, or the like. This shelf 28 is mounted to the rear wall 16 and side walls 12 and 14. The shelf has a fireproof container or ashtray 30 for tobacco ashes and litter.

The rear wall 16 and side walls 12 and 14 preferably extend from approximately an individual's waist to an eight (8) foot height and are free of the floor, although the present invention could easily be adapted to accommodate a smoker confined to a wheelchair by lowering the booth to the appropriate height and enlarging the access aperture. Optionally, a floor and full length side and rear walls could be utilized in accordance with the invention for certain applications.

The top or ceiling 36 of the booth 10 is shaped to conform to the flat rear wall 16 and the curved side walls 12 and 14. The rear portion of the ceiling curves downward via a curved molding 34 into the flat rear wall 16 to create a surface that aids in moving smoke toward the ceiling 36 and the front of the booth 10 (see arrows). The front edge of the ceiling continues the smooth curve of the side walls 12 and 14 and extends slightly beyond front edges 24 and 26. This extension permits the air intake opening 48, located at the front of the ceiling 36, to be at the most advantageous position to capture smoke from within the booth 10 and prevent its escape into the surrounding environment.

Above the ceiling 36 is the air handling and filtration compartment 38. This compartment 38 is formed by the ceiling 36 as its bottom surface, the rear wall 16, a curved trim band 40 on the sides, and the booth's upper surface 42 on the top. Access to the air handling and filtration compartment 38 for service and repair is through the filter access hatch 44 located in the upper surface 42. The exit for clean, filtered air from the air handling and filtration compartment 38 is through the exhaust ports 46 preferably located at the rear of the top surface 42.

In accordance with the present invention, the rear wall 16, ceiling 36, air handling and filtration compartment 38, curved trim band 40, upper surface 42, filter access hatch 44, and convenience shelf 28 of the smoker's booth 10 are preferably made essentially from strong, durable, fireproof or retardant, and easily cleaned materials, such as wood, aluminum, stainless steel, or molded fiberglass. The curved side walls 12 and 14 are preferably made of durable, high impact or shatterproof, easily cleaned, translucent, transparent, or opaque plastic materials, or laminated safety glass.

As depicted in FIG. 2, the air/smoke mixture is directed along a single flow path extending forwardly within the smoker's booth and thereafter extending rearwardly within the smoker's booth. Fan 56 is of sufficient capacity to prevent the smoke/air mixture from exiting the booth through the smoker's access. Lip 48' also aids in effectively preventing such exit of smoke/air mixture.

Stated differently, the smoke/air mixture is vented in a single, oppositely directed, parallel flow path from the smoker's booth, as clearly depicted in FIG. 2. This specific flow path provides a further advantage in that the 180° reversal of flow direction tends to bring particulate matter, tars, and resins entrained in the smoke/air mixture into the vicinity of air intake opening 48.

Referring specifically to FIG. 2, there is shown the preferred arrangement of a proximity sensor 58, light 60, filters 50, and 54, and fan 56 within the air handling and filtration compartment 38. The air intake opening 48 is located at the forward edge of the ceiling 36 just outside the front edges 24 and 26 of the side walls 12 and 14. This positioning of air intake opening 48 takes advantage of the preferred wrap-around structural shape to capture primary and secondary smoke and move it toward the front access aperture 18 in an air flow pattern created by the fan 56. The high flow rate of air in the vicinity of the air intake opening 48 completely captures any smoke created within the booth 10 even though the front access aperture 18 remains open. The air/smoke flow patterns created by the high volume fan 56 and curved or wrap-around structure of the booth 10 are illustrated in FIG. 2 by the large straight and curved arrows within the booth and air handling and filtration compartment 38.

As can also be seen in FIG. 2, the smoke-air or contaminated gas mixture first encounters a reaction chamber 51, such as an irradiation device for bacteria or viruses, mixing devices, or the like, as discussed herein, or particulate filter 50 that removes large, coarse particles, lint, and hair. The smoke-air mixture next enters an electrostatic filter 52 (actively or passively charged (e.g., plates or oriented polypropylene materials or the like) or precharged (e.g., foam)) that precipitates the fine smoke (tobacco ash) particles. The last filter element in the series is activated charcoal 54 to absorb or adsorb noxious tars and resins and remove odors. The filter elements are easily removable for cleaning and service through the filter access hatch 44. Filters employing HEPA or ULPA technology may also be utilized. Additionally, the circulated air or gas may be subjected to irradiation, chemical or physical treatment, ozone fluidized bed reactions, and the like, to eliminate bacterial and viral agents, volatile organic compounds, contaminants, etc. Filters which are particularly suited for nicotine smoke may be employed. The terms "filter" or "filters" is intended to include all of the above.

A proximity sensor switch 58 is located in the ceiling just inside the front access aperture 18. This switch 58 senses an individual entering the booth and automatically turns on the fan 56, electrostatic filter 52, and booth light 60. When the smoker exits the booth, the proximity switch 58 or an additional sensor detects the absence of someone within the booth and automatically turns the system off following a preset variable delay period to complete evacuation and filtering of any residual smoke within the booth. Infrared, sonic, and capacitive sensors, and the like, are useful in accordance with the invention. The sensor switch 58 can also be used in connection with a timer (not shown) to keep track of the usage of the booth and accordingly provide at predetermined intervals a signal that maintenance or cleaning should be done.

The light 60 is recessed and located centrally in the ceiling 36 to provide light whenever the booth venting and filtering systems are operating. The light 60 is automatically controlled by the proximity switch 58.

FIG. 3, a top cutaway plan view of the booth 10, best illustrates the location of the air inlet 48 and the flow of air and smoke (see arrows) within the booth 10 and through the air plenum chamber 62, filters 50, 52, and 54, and fan 56.

Figure 4:
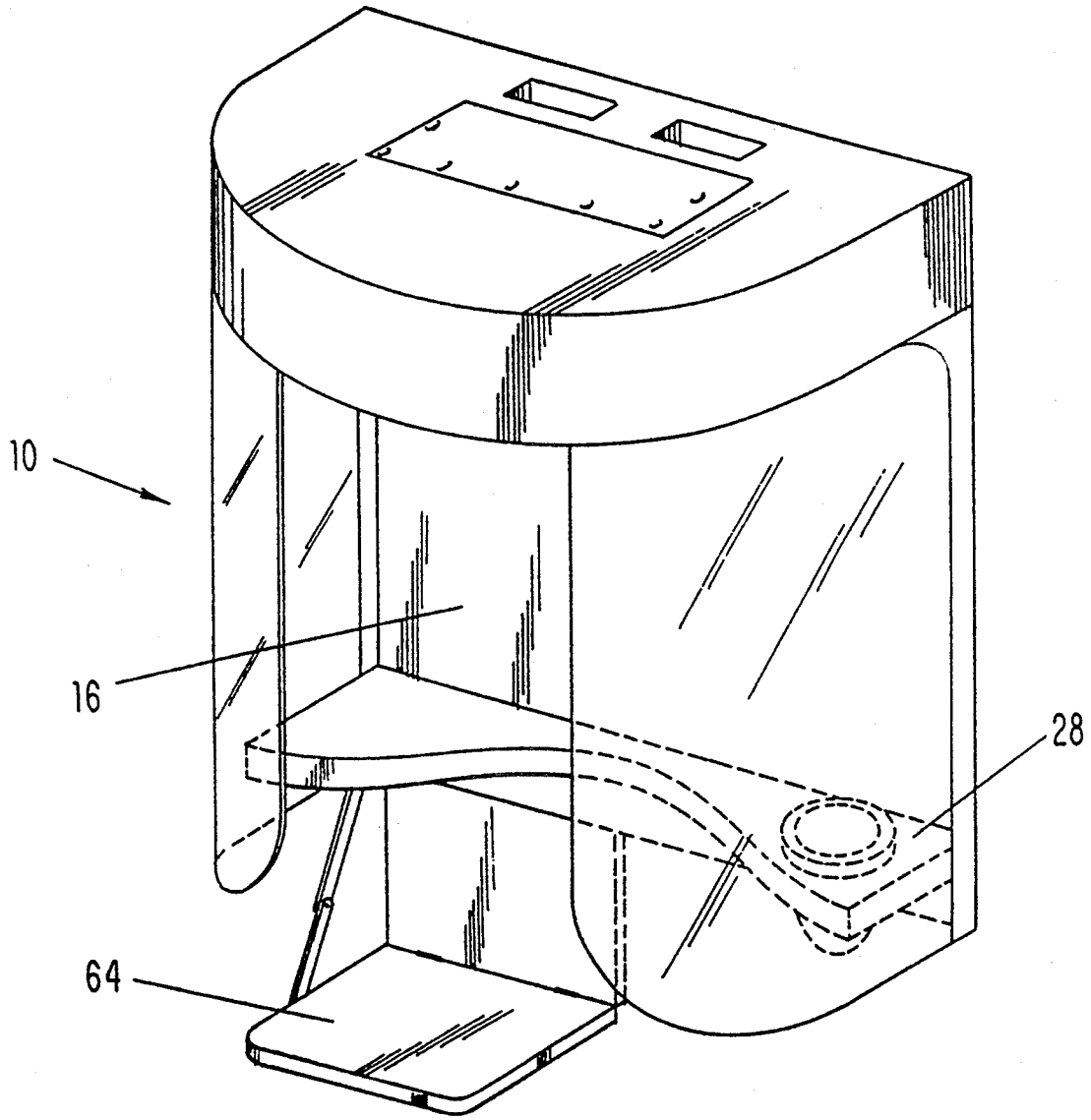
FIG. 4 is a perspective view of an alternative embodiment showing a seat that folds down from the back wall beneath the convenience shelf.

FIG. 4 illustrates an alternative embodiment that includes a fold-down seat 64 located on the back wall 16 beneath the convenience shelf 28. This invention could also be tailored to accommodate two smokers with the appropriate increase in dimensions and addition of a second ashtray and folding seat. Likewise, other types of seats, couches, or the like, may be provided.

Figure 5:
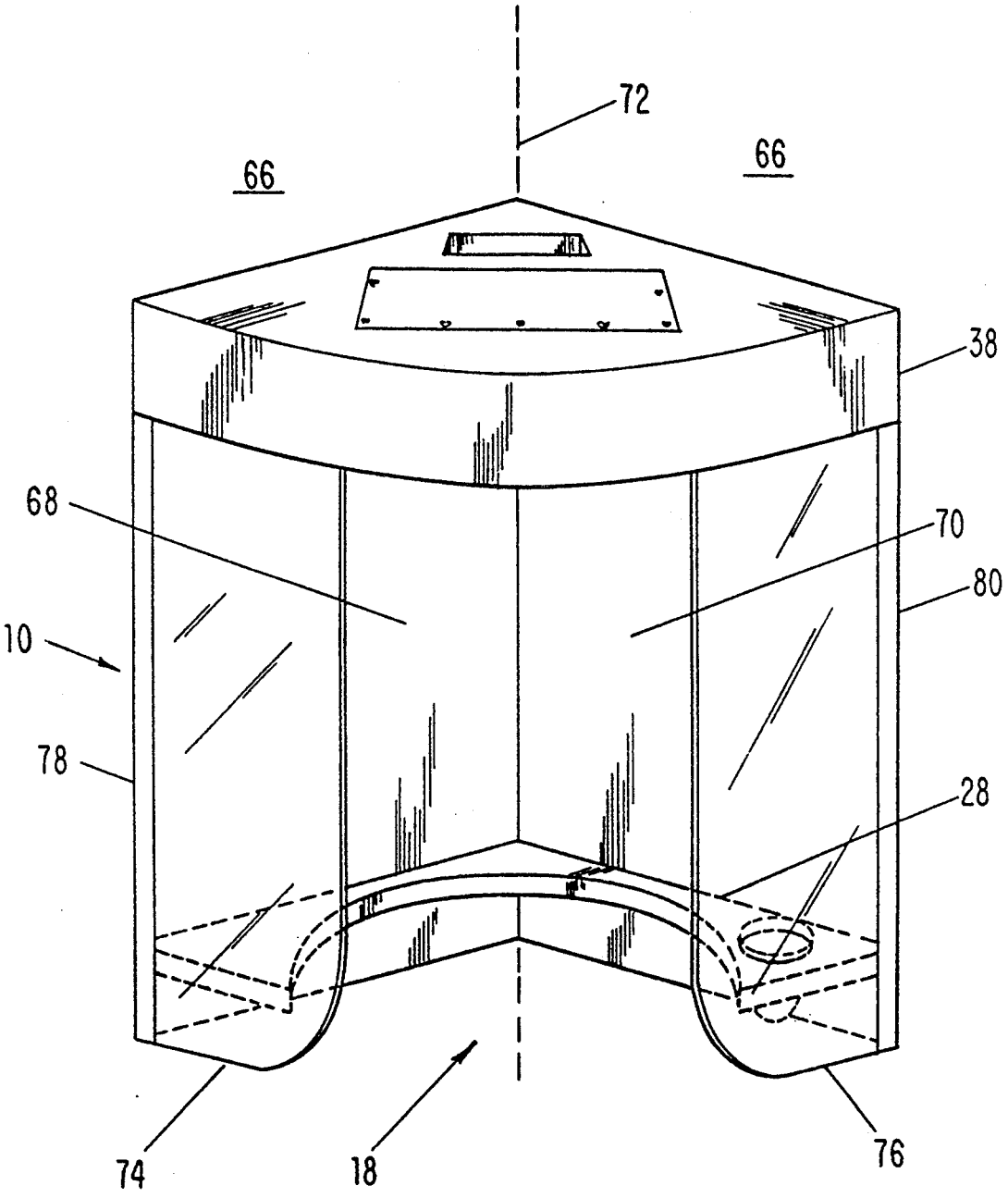
FIG. 5 is a perspective view of an alternative embodiment showing a configuration for mounting the smoker's booth in the corner of two walls.

FIG. 5 shows an alternative embodiment that includes a configuration for mounting the smoker's booth in the corner 72 of two facility walls 66. This configuration comprises four walls, two of which 68 and 70 are flat and joined at the corner 72 of the two facility walls to form the rear of the volume enclosure, and two of which 74 and 76 form right angles with the facility walls at the outside vertical edges 78 and 80 of the flat rear walls 68 and 70 and curve smoothly inwardly to form the smoker's front access aperture 18. The smoker's booth 10 is enclosed on the top by a ceiling and air handling, venting, and filtration compartment 38 (such as discussed above) that conforms to the shape created by the lateral walls 68, 70, 74, and 76 and the front access aperture 18. A convenience shelf 28 is attached to both flat rear walls 68 and 70 and both curved side walls 74 and 76. Other components of the corner configuration booth 10 are similar to those of the preferred embodiment discussed above.

Figure 6:
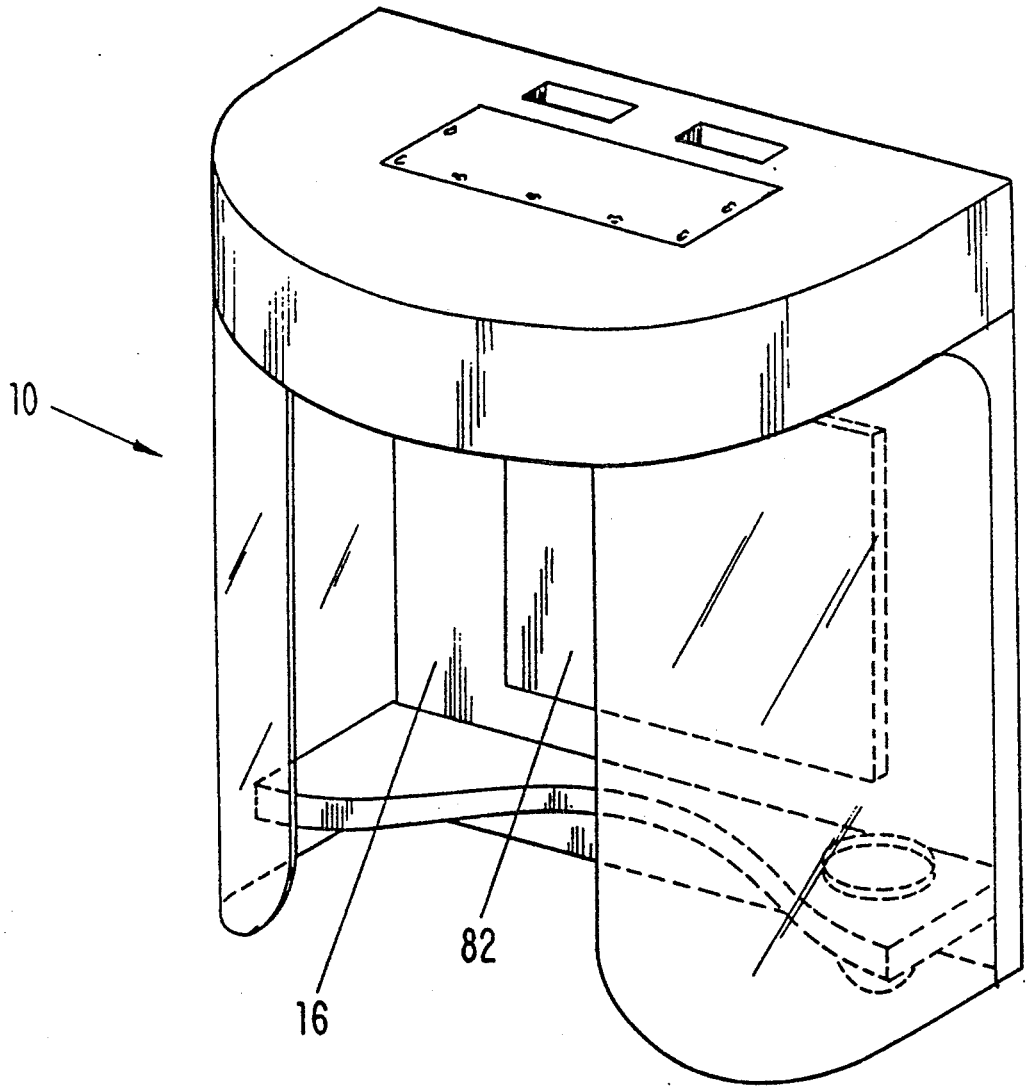
FIG. 6 is a perspective view of the FIG. 1 embodiment showing the rear wall for use as advertising space.

FIG. 6 illustrates an alternative embodiment wherein the rear wall 16 is adapted for use as advertising space or other indicia Other possible, but not all inclusive, uses for the rear wall 16 or side walls are as spaces for appropriately sized vending machines (such as cigarette, butane lighter, breath fresheners, chewing gum, etc.) telephones, magazine racks, televisions, and the like.

Figure 7:
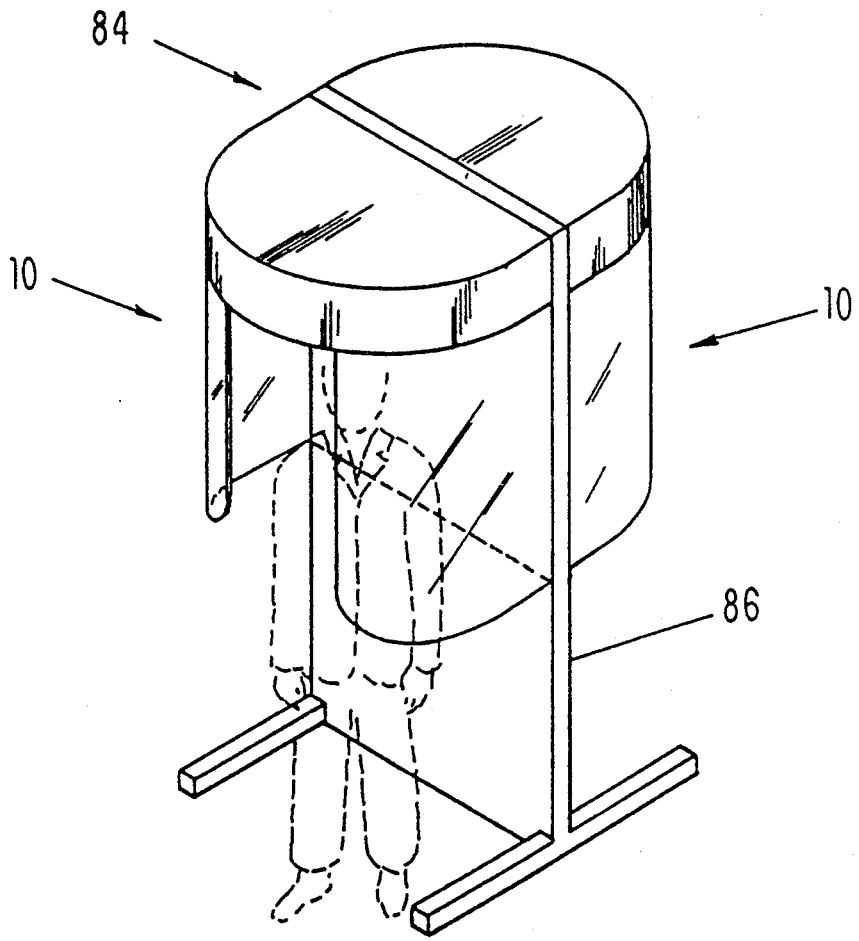
FIG. 7 is a perspective view of an alternative embodiment showing two smoker's booths back-to-back with a supporting structure that permits the invention to be floor mounted or free standing.

FIG. 7 shows yet another embodiment wherein two smoker's booths 10 are positioned back-to-back 84 with a supporting structure 86 that permits the present invention to be free standing or floor mounted. As can be appreciated by those skilled in the art, any number of booths can be Joined in multiple configurations (e.g., three, four, and more) to allow the booths to be combined using shared or common rear walls, side walls, bases, and the like.

Figure 8:
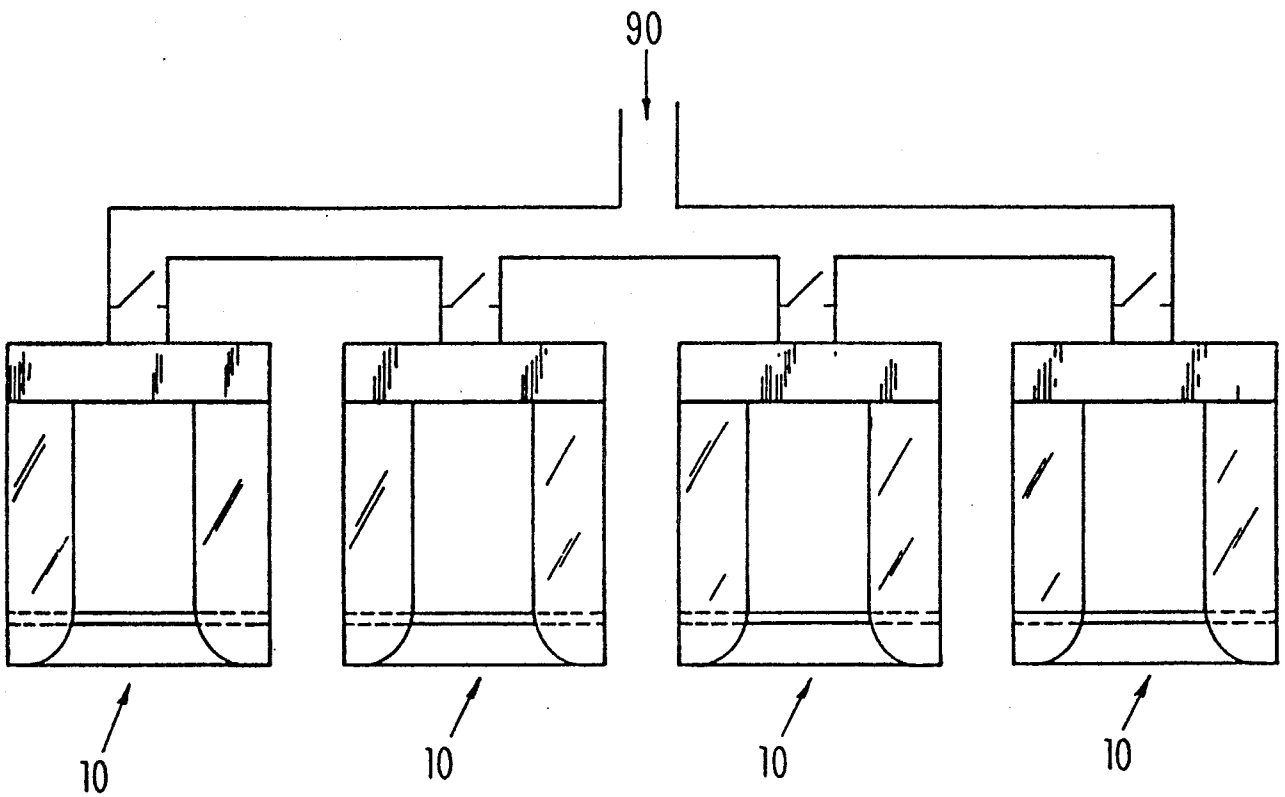
FIG. 8 is a front view of an alternative embodiment showing a plurality of smoker's booths joined by ducting that moves exhausted air to the facility heating, ventilating, and air conditioning system, or vents the air and smoke to the outside.

FIG. 8 illustrates another alternative embodiment having two or more booths 10 joined by common ducting 88 that moves the exhausted air, filtered or non-filtered, to a common heating, ventilating or air conditioning (HVAC) system 90 or vents the air and smoke to the outside. This same air handling technique could be applied to a single booth if convenient access to a facility HVAC system ducting is readily available or the unit is located where venting to the outside is practical.

Figure 9:
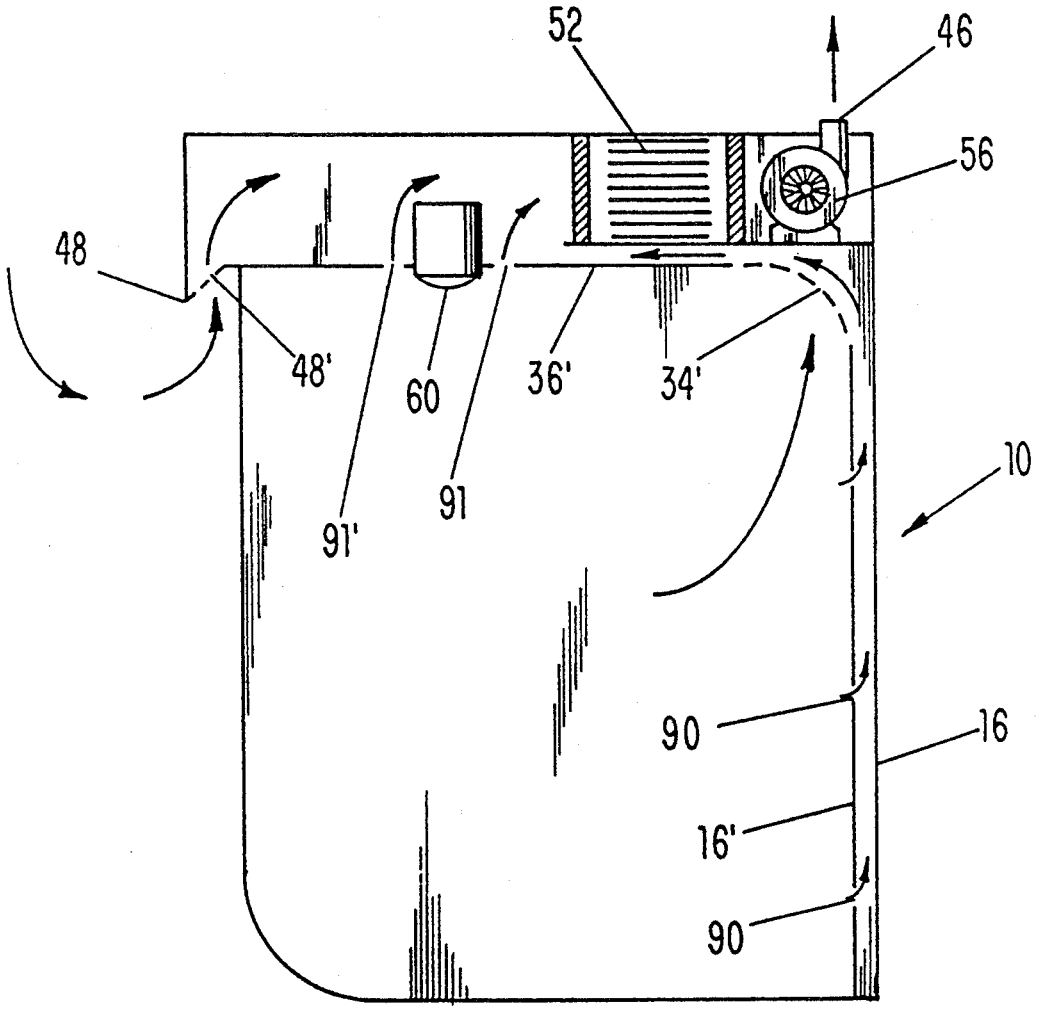
FIG. 9 is a side view of still another alternative embodiment showing an apertured paneled rear wall.

FIG. 9 illustrates still another alternative embodiment of the invention. In this embodiment, smoker's booth 10 further comprises ducted back wall 16 and projecting lip 48. (The term "ducted", as used in describing the FIG. 9 and 10 embodiments of the invention, relates to the provision of passages for flow of smoke, air, or smoke/air mixtures. Such passages may be provided by any means known to the art, such as paneling, tubing, pipes, and the like.) Ducted back wall 16, by virtue of the space between panel 16' and wall 16, effectively comprises a duct for passage of the smoke/air mixture. Access to this duct is provided by a plurality of apertures 90 in panel 16'. Apertures 90 may comprise various shapes, and are preferably regularly and symmetrically positioned on panel 16'. For example, apertures 90 may comprise circular holes, slots, square holes, and the like. The only limitations on the apertures are that there be a sufficient plurality of apertures such that the passage of smoke and air is not substantially diminished by closure of a few apertures; and that the size of each aperture be sufficiently small such that most refuse and debris is denied entry therethrough.

Curved molding 34' is also ducted by tubing, being hollowed, paneled, perforated, or the like, to thereby provide passage for the smoke/air mixture.

Ceiling 36', adjoining ducted molding 34', may also be ducted as by paneling, tubing, being hollowed, or the like, as at 36', thereby further providing passage for the smoke/air mixture. Apertures 91 may also be provided in ceiling 36'.

FIG. 9 also illustrates lip 48' on ceiling 36' which more effectively captures smoke/air mixtures via apertures 48' from within booth 10, and, additionally, more effectively prevents its escape into the surrounding environment.

Figure 10:
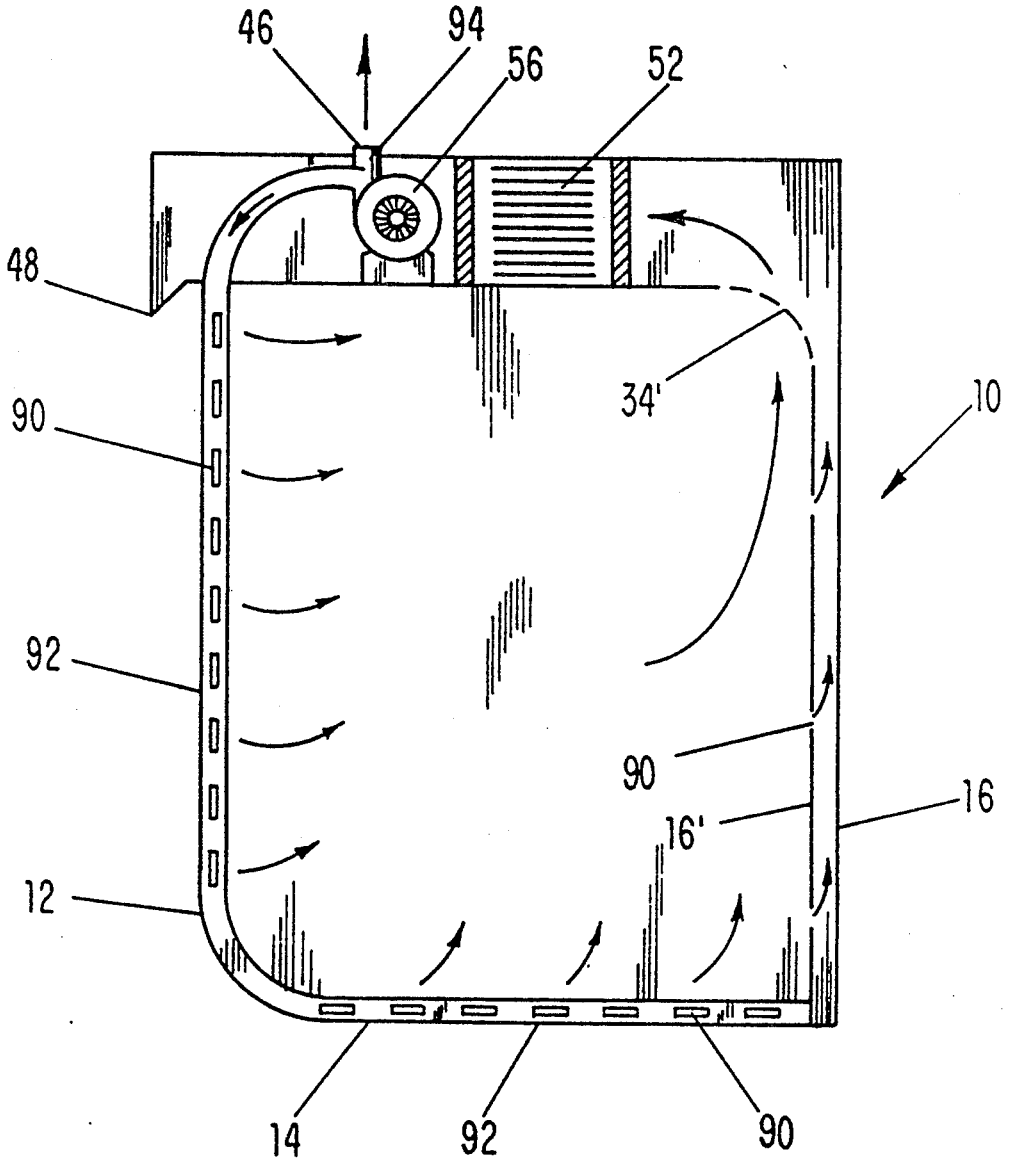
FIG. 10 is a side view of yet another alternative embodiment showing apertured ducts on the sides and bottom of the side walls in addition to an apertured paneled rear wall.

FIG. 10 depicts yet another alternative embodiment of the invention. Similar to the FIG. 9 embodiment in that an apertured ducted rear wall 16 is present, the FIG. 10 embodiment additionally provides the side and/or bottom edges of side walls 12,14 with apertured ducting 92. Additionally, fan 56 is positioned forwardly of filter 52. A portion of high pressure filtered exhaust air is "bled" off or diverted at 94 and recirculated through apertured ducting 92. Recirculated high pressure air exits from apertured ducting 92, sweeping and purging the smoke/air mixture from the interior of smoker's booth 10 into apertured ducted rear wall 16, which is at relatively lower pressure. The purged smoke/air mixture is sucked through filter 52 and directed, where it is exhausted at 46, and a portion thereof redirected at flap 94 and recirculated.

Similarly to the FIG. 9 embodiment, the apertures 90 may be of any desired configuration subject only to the requirements of being large enough to allow passage of an adequate volumetric rate of air flow, small enough to deny access to and deter deposition or accumulation of debris, and numerous enough to provide adequate flow despite blockage of one or more apertures. Ducting 92 may comprise plastic, metal, or rubber tubing, such as thermoplastic or thermosetting resin, copper, PVC, and the like.

The flow path of the FIG. 9 embodiment is the same as that of preceding embodiments: a single flow path extending forwardly within the smoker's booth, then rearwardly through the smoker's booth; or a single, directed flow path. The flow path of the FIG. 10 embodiment is a single, circuitous, partially recirculatory flow path.

Obviously the smoker's booth of the FIGS. 9 and 10 embodiments can also be configured in back-to-back configuration, as in FIG. 7, or in a plurality of booths, as in the FIG. 8 embodiment.

Figure 13:
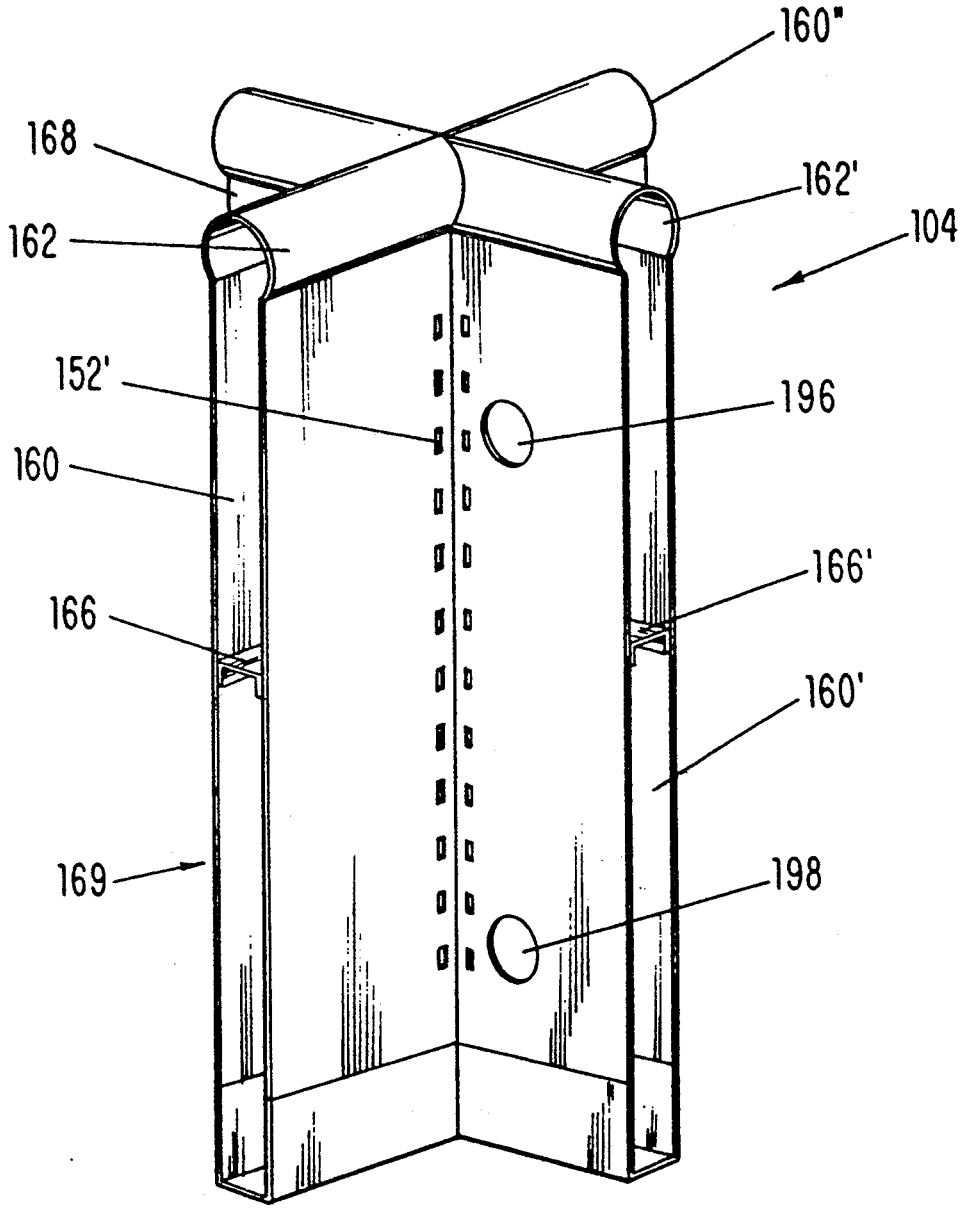
FIG. 13 is a perspective view of the divider wall coupler unit of the FIG. 11 embodiment.
Figure 14:
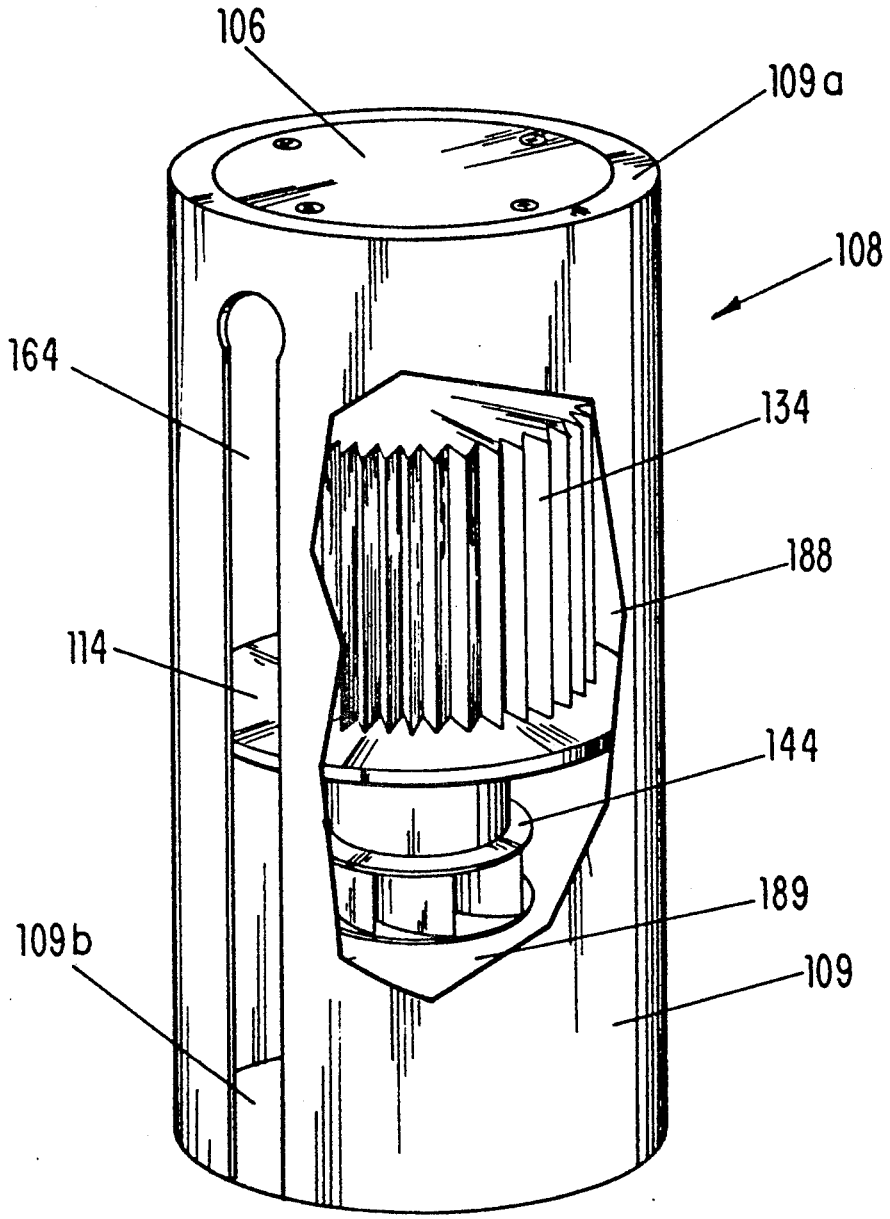
FIG. 14 is a perspective view of the blower and filtering node of the embodiment of FIG. 11, with a section cut away to reveal the fan and filter elements.
Figure 15:
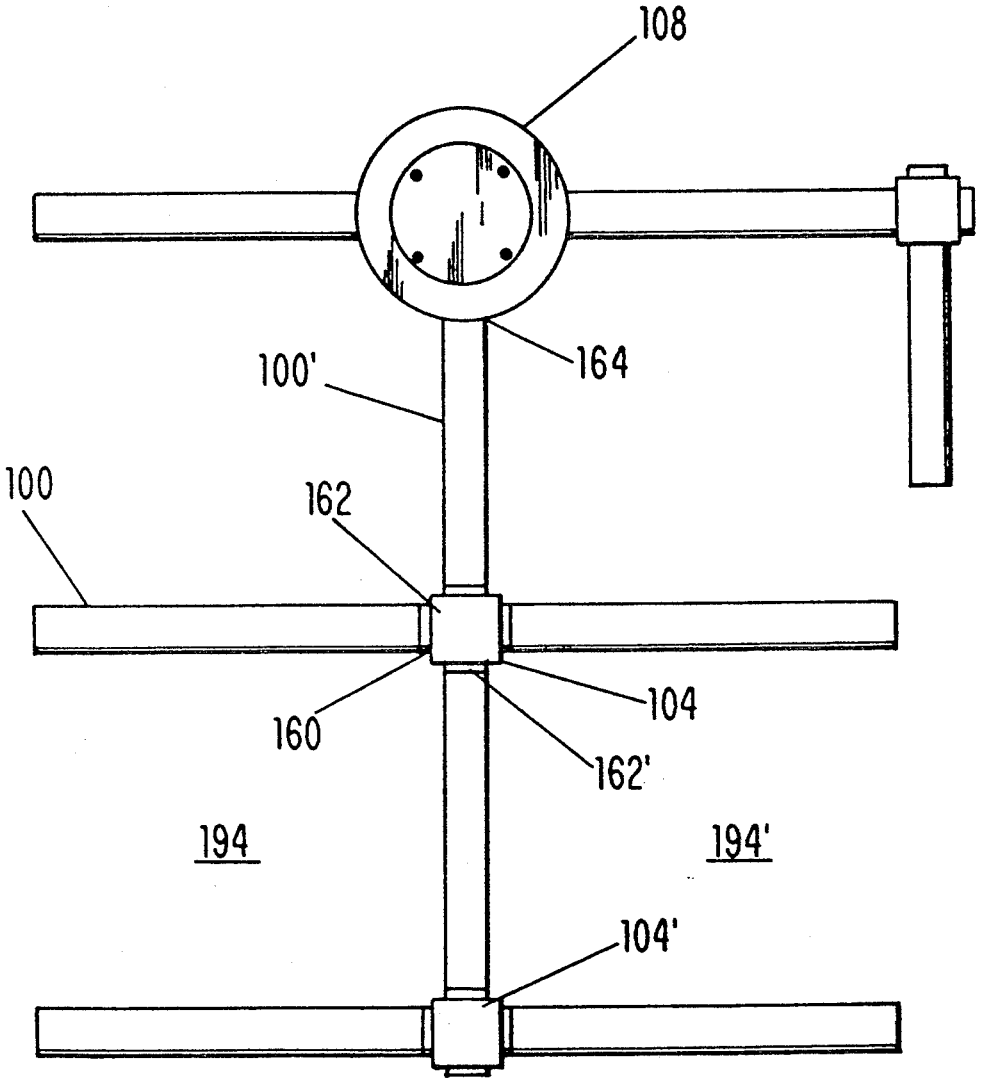
FIG. 15 is a plan view of the integrated modular divider system of the FIG. 11 embodiment.

Reference is now made to FIGS. 11-15, collectively depicting a modular divider system, still another alternative embodiment of the invention. In this embodiment, at least one, and preferably two or more, wall components, shown generally at 100,100', are joined together at their respective ends by one or more coupler units 104,104'. As best shown in FIG. 15, any number of wall components 100,100' may be so interlinked as to form a wall network to compartmentalize a larger room. Wall components 100,100' typically will be joined at right angles by coupler units 104,104', although coupler units 104,104' may be configured so as to allow the connection of two, three, four or more wall components 100,100' at virtually any number and size of angles.

Also as shown by FIG. 15, the network of wall components 100,100' is joined by one wall component 100 to at least one central fan and filtration node 108. The central fan and filtration node 108 serves as the active component of the modular office divider system, and contains air delivery and filtration elements to be described hereafter. Every system network includes at least one central fan and filtration node 108, but in principle an effective large system would incorporate a plurality of central fan and filtration nodes 108 working in concert.

The entire divider system is manufactured of sturdy, yet lightweight materials to foster system portability. This alternative office divider system of the invention preferably is portable and flexible. Because the system comprises an assembled network of modular units, it may readily be dissembled for removal and use at another location. The modular and portable character of the system also allows for tremendous flexibility; the network of dividers and couplers may be modified, expanded, or reduced to accommodate changing needs of the users.

Figure 12:
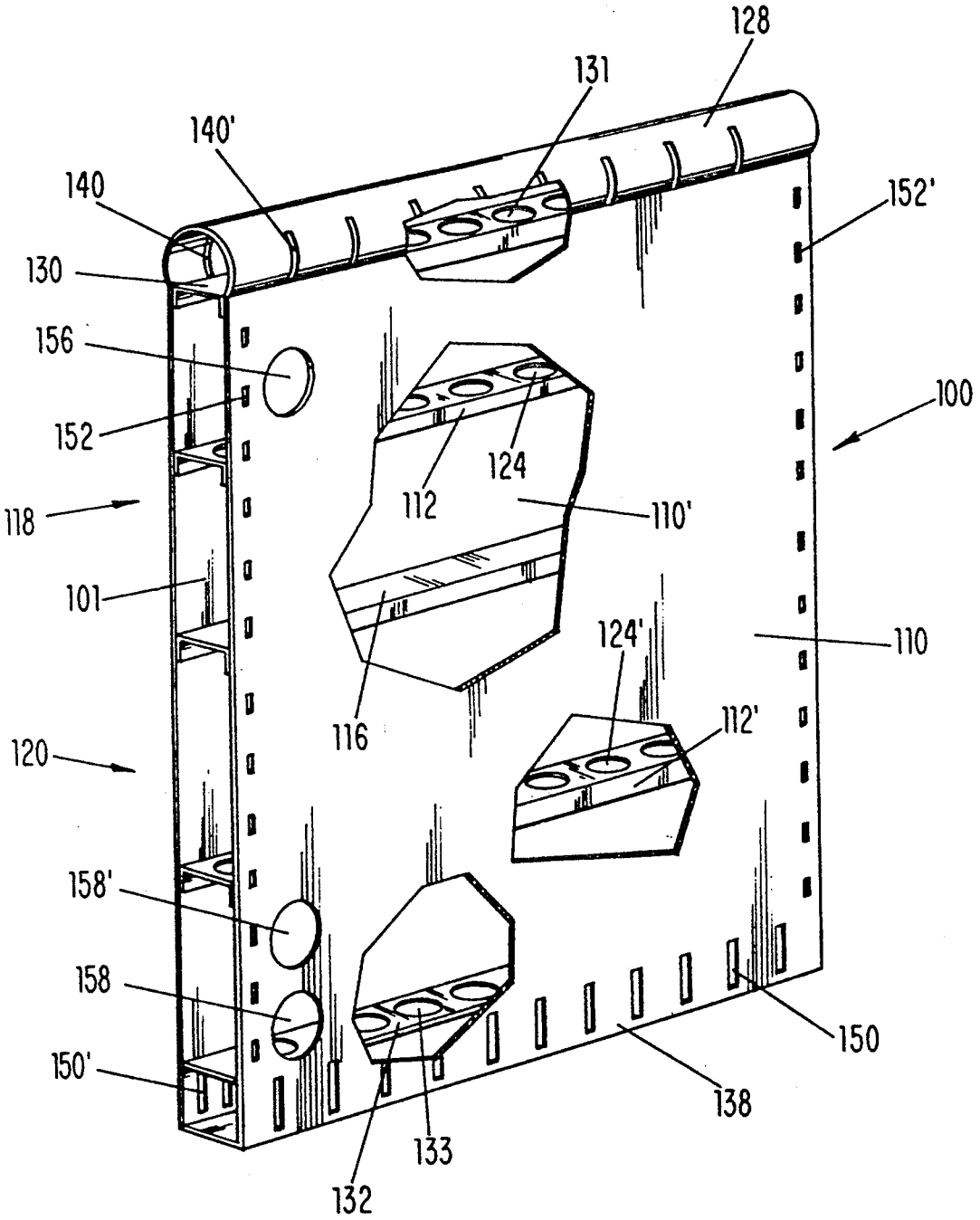
FIG. 12 is a cut-away perspective view of the apertured modular divider wall of the FIG. 11 embodiment.

FIG. 12 depicts in detail the features of a wall component 100. Wall component 100 normally consists of two parallel planar panels 110,110' enclosing a hollow interior space between them. Panels 110,110' are rigidly spaced by two or more horizontal members 112,112' which run the width of the wall component 100, separate the panels 110,100', and add rigidity and strength to the overall wall component 100. Also running the width of wall component 100 is horizontal septum 116, which divides the space between panels 110,110' into an upper duct 118 and a lower duct 120. Horizontal septum 116 is so installed as to provide a solid barrier between upper duct 118 and lower duct 120 that is impermeable to air. Horizontal septum 116 also adds rigidity to wall component 100. Panels 110,100', horizontal members 112,112' and horizontal septum 116 are all fashioned from a sturdy, lightweight material generally impermeable to air, such as alloys of aluminum or other metals, plastic, and the like.

As can be viewed in FIG. 12, horizontal members 112,112' are perforated with openings 124,124' which allow free exchange of air between ducts 118 and 112; that is, if a horizontal member 112 is disposed within upper duct 118 or lower duct 120, as shown in FIG. 12, horizontal member 112 shall not divide the duct into separate air chambers. Each wall component 100 has a top member 130 and a bottom member 132 substantially identical to horizontal members 112,112'.

Mounted along the top edge of wall component 100 is vented hood 128, which is generally tubular with a plurality of intake ports 140,140' (consisting of slits, as shown, or other perforations). The interior of vented hood 128 is in fluid communication with upper duct 118 via openings through top member 130.

With continued reference to FIG. 12, it is seen that the bottom of wall component 100 is fitted with vented base 138, which is generally shaped as a hollow rectangular box perforated with a plurality of exhaust ports 150,150' (consisting of slits, as shown, or other orifices). The interior of vented base 138 is in fluid communication with lower duct 120 via openings through bottom member 132. Vented hood 128 and vented base 138 are made of any lightweight, rigid material.

The entirety of the vertical ends of wall component 100 are open to comprise end aperture 101. Accordingly, when wall component 100 has not been integrated into an assembled system, lower duct 120 and upper duct 118 are in fluid communication with the exterior of wall component 100. Unless inserted into a coupler unit 104, the end apertures 101 (which includes the ends of vented hood 128 and vented base 138) are closed and sealed when the invention is being practiced. Such closure may be accomplished with a custom-fit, removable dummy plug 136 as depicted in FIG. 11.

Figure 11:
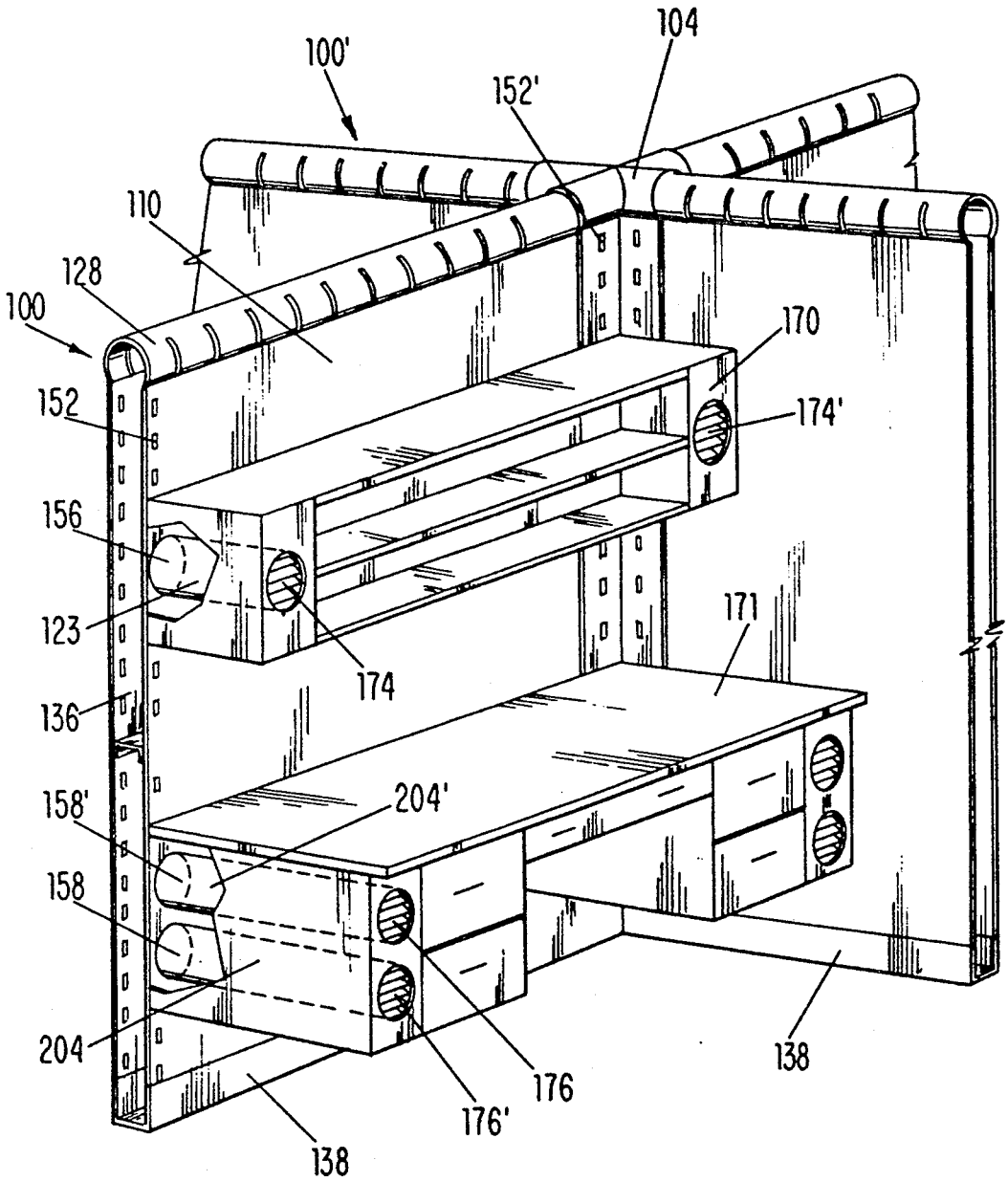
FIG. 11 is a perspective view of an alternative embodiment of the invention, showing the walls, coupler, and furniture elements of the modular divider system.

Wall component 100 may optionally include features to accommodate the installation of customized furniture accessories 170,171, as shown in FIG. 11. FIG. 12 shows a plurality of mounting slots 152,152' in panel 110, uniformly aligned along a vertical line at each end of wall component 100. Mounting slots 152,152' may be disposed on either or both sides of wall component 100. Mounting slots 152,152' receive mounting hooks or brackets protruding from the furniture accessories, to allow the secure attachment (temporary or permanent) of furniture accessories 170,171, as depicted in FIG. 11.

Other mounting methods, such as screws, bolts, or the like, may also be used.

With continued reference to FIG. 12, it is seen that panel 110 of wall component 100 optionally may feature one or more intake apertures 156 and one or more exhaust apertures 158. Intake and exhaust apertures 156,158 are so disposed as to align with corresponding inlets 174 and outlets 176,176' in furniture accessories 170,171, as shown in FIG. 11.

Reference is made to FIG. 11. If and as desired, furniture accessories 170,171 are mounted upon wall components 100 using mounting slots 152 in wall components 100 an/or coupler unit 104. Any furniture accessory 170 mounted on the upper portion of component wall has inlets 122,122 and inlet ducts 123. Care is taken when mounting upper accessory 170 to align inlet ducts 123 with intake apertures 156. Lower furniture accessory 171 is similarly equipped with exhaust outlets 202,202' (four shown) with associated exhaust ducts 204,204'. Exhaust ducts 204,204' are aligned with exhaust apertures 158,158'. The terms "furniture," "furniture accessories," and "furniture means," as used throughout this specification and claims, are intended not only to include standard office furniture but also other articles or elements which may utilize or require filtered air or gas.

FIG. 13 details the configuration of coupler unit 104, whose use is more generally depicted in FIGS. 11 and 15. Coupler unit 104 functions primarily to join two or more wall components 100 and direct airflow therebetween. Coupler unit 104 may be constructed to Join two or more wall components 100, with a "four-way" coupler unit 104 being shown in FIG. 13. Each coupler unit 104 consists of hollow, vertical wall-receiving bays 160,160',160". The interiors of wall-receiving bays 160,160',160" share a common hollow core at the vertical axis of the coupler unit 104, such that air entering any well receiving bay 160 can freely enter the adjacent bays 160',160".

Each wall receiving bay 160 is adapted to receive an assembled wall component 100, as more generally shown in FIG. 11. It will be appreciated, however, that not every wall-receiving bay 160,160' must accept an inserted wall component 100; any wall-receiving bay 160 not receiving a wall component 100 may simply be stopped or filled with a custom dummy plug (not shown), substantially identical to the dummy plug 136 as shown in FIG. 11. By using dummy plugs, a four-way coupler unit 104 like that shown in FIG. 13 may be adapted for use with only two or three wall components 100.

Each receiving bay 160,160' is topped with a crown 162,162 which receives the vented hood 128 of the inserted wall component 100. Each receiving bay 160,160' also is fitted with a separating septum 166,166' corresponding in vertical location to the horizontal septum 116 of the inserted wall component 100. Accordingly, coupler unit 104 is divided by contiguous septums 166,166 into an upper chamber 168 and a lower chamber 169, functional analogues of the upper duct 118 and lower duct 120, respectively, of wall component 100. Coupler unit 104 is constructed as to be generally airtight, so that when accommodated with wall components 100, the interiors of the wall components 100 and the coupling unit 104 form a closed duct system.

Continued reference is made to FIG. 13. It is observed that each wall-receiving bay 160 optionally is provided with mounting slots 152, intake apertures 196, and outlet apertures 198 whose general structures and functions are identical to the analogous features described above for the wall component 100. These optional features allow the attachment upon coupler unit 104 of the furniture accessories 170, 171 described above. Intake and outlet apertures 196, 198 may be plugged if not used.

Reference is now made to FIG. 14, detailing the features of the central fan and filtration node 108. The fan and filtration node 108 preferably is a right cylinder, but may assume any practical shape. Fan and filtration nodes 108 shaped like vertical cylinders are easily integrated into the modular office divider system, as shown in FIG. 15, and also present a minimum of construction seams (as node 108 is to be of generally airtight construction, excepting the presence of wall component slots 164, to be described. Fan and filtration node 108 is constructed of sturdy, lightweight, air-impermeable substances such as aluminum and plastic and the like.

Fan and filtration node 108 comprises housing 109 (including top 109*a* and bottom 109*b*) which encloses within its hollow interior certain working parts, and which also acts as the supporting structure. The contained interior of housing 109 is divided by node septum 114 into upper filter chamber 188 and lower blower chamber 189. Filter access hatch 106 is located on the top 109*a* (as shown in FIG. 14) or alternatively a side of housing 109 to permit access to the interior of filter chamber 188. Filter access hatch 106 preferably has a gasket (not shown) such that when closed it has an airtight seal.

Disposed within filter chamber 188 is air filter 134, of similar type and substantially identical function as the filters 50,52 of the preferred embodiment of FIG. 2, except that filter 134 will be larger to accommodate the larger capacities and discharges of a modular office divider system. Located within the blower chamber 189 is blower fan 144. Fan 144 is of similar type and substantially identical function as the fan 56 of the embodiment of FIG. 2, except that fan 144 has a correspondingly higher horsepower and capacity rating to move the greater volumes of air blown through the office divider network. Passage of moving air between filter chamber 188 and blower chamber 189 is only via filter 134, which has exhaust port (not shown) passing through node septum 114.

With continued reference to FIG. 14, it is noted that housing 109 has one (or more) wall component slots 164 configured to receive an inserted wall component 100. Wall component slot 164 serves a purpose very similar to wall receiving bay 160 in coupler unit 104. As illustrated in FIG. 15, an end of wall component 100 is inserted into fan and filtration node 108 to assemble the overall modular office divider system. More than one fan and filtration node 108 may be included in a large modular divider system, and various nodes 108 may have an assortment of numbers and configurations of wall component slots 164 to allow for system flexibility. As with coupler unit 104, unused wall component slots 164 may be plugged with a dummy plug (not shown).

When wall component(s) 100 are inserted into slots 164 of fan and filtration node 108, horizontal septum 116 of component 100 abuts or overlaps node septum 114 in a generally airtight contact. Thus, air moving through a wall component upper duct 118 cannot pass into blower chamber 189 without first being sucked through filter 134 by fan 144.

Assembly of a modular office divider network is generally depicted in FIGS. 11 and 15. One or more wall components 100 are inserted into one or more coupler units 104, to form a grid-like network of walls defining one or more office cubicles 194,194'. At least one wall component 100 is inserted into a slot 164 of a central fan and filtration node 108. The end of any wall component 100 not inserted into either a coupler unit 104 or a node 108 is capped with a dummy plug 136, as illustrated in FIG. 11. Similarly, any unused intake or exhaust apertures 156,158 (FIGS. 11 and 12) are plugged. Connection of the various components of the system preferably is accomplished using suitable gaskets to preserve the general airtightness of the system.

Once assembled, the modular office divider system is straightforwardly operated as a means of controlling tobacco smoke and other air pollutants. It is readily seen that when the various wall components 100, coupler units 104, and nodes 108 are properly interconnected, the entire assembly is a closed loop duct permitting the recirculation of air. When blower fan 144 is activated, reduced air pressure results in filter chamber 188. This reduction in pressure also pervades the upper ducts 118 of wall components 100 and the upper chambers 168 of all coupler units 104, since chamber 188, chamber 168 and upper ducts 118 are in mutual communication.

As a consequence of the reduced pressure in upper duct 118, ambient air (with any suspended contaminants) in office cubicles 194,194' (FIG. 15) is sucked into the vented hood 128 atop each wall component 100. Additionally, or alternatively, ambient air is pulled into the inlets 174 in upper furniture accessories 170. Contaminated air thus pulled into the system flows through the interconnected upper ducts 118 in the various wall components 100, through the upper chambers 168 of the coupler units 104, and into the filter chamber 188, where suspended contaminants are removed by the filter 134.

Filtered air is then pulled by the action of blower fan 144 into blower chamber 189. Under pressure from blower fan 144, filtered air is expelled from blower chamber 189 and forced through lower ducts 120 (via lower chambers 169 of coupler units 104) and delivered to the various office cubicles 194,194'. Filtered air is expelled from the system via the vented bases 138 in the wall components 100, or alternatively or additionally through the outlets 176,176' in lower furniture accessories 171. The horizontal septums 116 in the wall components 100, the separating septums 166,166' in the coupler units 104, and node septum 114 act as a continuous barrier throughout the system, separating contaminated air from filtered air.

Alternatively, the filter 134 may be omitted, and the circulated air vented to the outdoors, as in the FIG. 8 embodiment.

Figure 16:
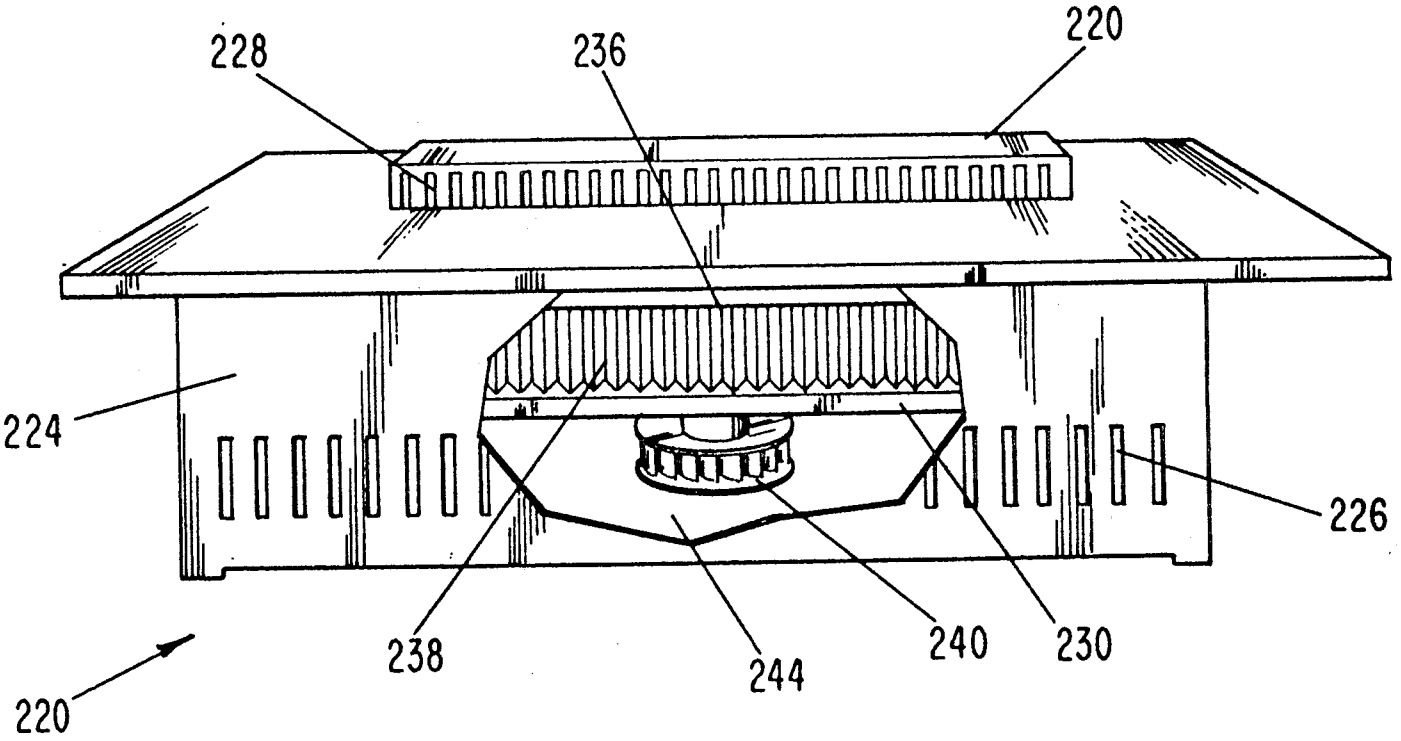
FIG. 16 is a front view of the free-standing furniture alternative embodiment of the invention, with a section cut away to reveal the fan and filter elements.

Reference is now made to FIG. 16, depicting still another alternative embodiment of the invention. FIG. 16 illustrates that the general concepts of the invention may be incorporated into a free-standing article of furniture 220. Lower portion of frame 224 of furniture 220 is perforated with exhaust vents 226. Disposed on any upper portion of frame 224 are intake vents 228. The interior of furniture 220 is separated into two chambers by rigid diaphragm 230. Disposed in top chamber 236 is filter element 238, in fluid connection with blower fan 240 in bottom chamber 244. When blower fan 240 is actuated, contaminated air is pulled through intake vents 228, into top chamber 236, and through filter element 238 where it is purified. According to the aforedescribed principles of the invention, the clean air is then expelled under pressure from bottom chamber 244 through exhaust vents 226 and into the ambient air. Alternatively, in lieu of a single large fan, a plurality of smaller fans and adjustable vents corresponding to individual stations may be used.

Of course, other embodiments of the present invention may achieve the same results without departing from the basic principles of the invention. Thus, for instance, according to the particular application contemplated, the number and kind of filter elements, the positions of the air inlet opening, filters, fans, the contours and positioning of the side and rear walls and ceiling, the translucent nature and materials of the side walls, and the relative dimensions of the component elements of the smoker's booth may be varied to the specific application required. Further, closing means could be added to close the smoker's front access aperture, for example, if a specific application is required. Such closing means comprises, for example, swinging doors, sliding doors, curtains, and the like. The smoker's booth of this invention can also be used in other applications; for example, as an enclosure around an easy chair or couch in a lounge area, restaurant, or the like, by simply adapting the components of the present invention to the specific purpose and circumstances contemplated. Likewise, the modular wall system could be used for any type of gaseous filtering under a variety of conditions (e.g., storage of articles or manufacturing workplace).

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application are hereby incorporated by reference.

What is claimed is:

1. A modular divider system having gas circulation and filtration comprising:

hollow wall means comprising a plurality of longitudinally disposed spaced aperture means;

filtering means for filtering gas from said hollow wall means, said filtering means remote from said hollow wall means; and means for circulating gas from outside said hollow wall means, through said hollow wall means and to said filtering means, and to outside of said hollow wall means.

2. The invention of claim 1 wherein said plurality of longitudinally disposed aperture means comprises a vented intake disposed across a top of said hollow wall means.

3. The invention of claim 1 wherein said plurality of longitudinally disposed apertures comprise vented base means disposed across a bottom of said hollow wall means.

4. The invention of claim 1 wherein said hollow wall means comprises air impermeable septum means for separating an intake duct section of said hollow wall means from an exhaust duct section of said hollow wall means.

5. The invention of claim 1 wherein said longitudinally disposed apertures are substantially evenly spaced along said hollow wall means.

6. The invention of claim 1 further comprising furniture means disposed on said hollow wall means.

7. The invention of claim 6 wherein said furniture means comprises furniture aperture means corresponding to said aperture means disposed in said hollow wall means.

8. The invention of claim 1 further comprising wall end intake aperture means and wall end exhaust aperture means.

9. The invention of claim 1 wherein said filtering means comprises means for filtering contaminants from said circulating gas.

10. The invention of claim 1 further comprising hollow wall coupling means.

11. The invention of claim 10 wherein said coupling means comprises septum means for separating filtered gas from unfiltered gas.

12. The invention of claim 10 comprising pluralities of hollow wall means and coupling means.

13. The invention of claim 12 wherein said pluralities of hollow wall means and coupling means have common air circulating means and filtering means.

14. The invention of claim 13 wherein said pluralities of hollow wall means and coupling means comprises rigid members.

15. The invention of claim 13 wherein said hollow wall means comprise gas receiving aperture means for receiving gas from outside said hollow wall means, gas exhausting aperture means for exhausting gas to outside said hollow wall means, and at least one horizontal structural member disposed within said hollow wall means comprising perforations for allowing vertical flow of gas within said hollow wall means.

16. A modular divider system having gas circulation and filtration comprising:

a plurality of rigid hollow wall means comprising gas receiving aperture means and gas exhausting aperture means;

filtering means for filtering circulating gas from said hollow wall means;

rigid first connector means for connecting a first portion of said plurality of rigid hollow wall means to said filtering means;

rigid second connector means for connecting a second portion of said plurality of rigid hollow wall means to said first portion of said plurality of rigid hollow wall means; and means for circulating gas from outside said rigid hollow wall means via said gas receiving aperture means, through said rigid hollow wall means and to said filtering means, and to outside of said rigid hollow wall means via said gas exhausting aperture means.

17. The invention of claim 16 wherein said gas receiving aperture means comprises a vented intake disposed across a top of said hollow wall means.

18. The invention of claim 16 wherein said gas exhausting aperture means comprise vented base means disposed across a bottom of said hollow wall means.

19. The invention of claim 16 wherein said hollow wall means comprises air impermeable septum means for separating an intake duct section of said hollow wall means from an exhaust duct section of said hollow wall means.

20. The invention of claim 16 wherein said aperture means comprises longitudinally disposed, substantially evenly spaced apertures along said hollow wall means.

21. The invention of claim 16 further comprising furniture means disposed on said hollow wall means.

22. The invention of claim 21 wherein said furniture means comprises furniture aperture means corresponding to said aperture means disposed in said hollow wall means.

23. The invention of claim 16 further comprising wall end intake aperture means and wall end exhaust aperture means.

24. The invention of claim 16 wherein said hollow wall means further comprise at least one horizontal structural member disposed within said hollow wall means comprising perforations for allowing vertical flow of gas within said hollow wall means.

25. A modular divider system having gas circulation and filtration comprising:

hollow wall means comprising gas receiving aperture means for receiving gas from outside said hollow wall means, gas exhausting aperture means for exhausting gas to outside said hollow wall means, and at least one horizontal structural member disposed within said hollow wall means comprising a plurality of perforations for allowing vertical flow of gas within said hollow wall means;

filtering means for filtering gas from said hollow wall means; and means for circulating gas from outside said hollow wall means via said gas receiving aperture means, through said hollow wall means and to said filtering means, and to outside of said hollow wall means via said gas exhausting aperture means.

26. The invention of claim 25 wherein said gas receiving aperture means comprises a vented intake disposed across a top of said hollow wall means.

27. The invention of claim 25 wherein said gas exhausting aperture means comprise vented base means disposed across a bottom of said hollow wall means.

28. The invention of claim 25 wherein said hollow wall means comprises air impermeable septum means for separating an intake duct section of said hollow wall means from an exhaust duct section of said hollow wall means.

29. The invention of claim 25 comprising longitudinally disposed, substantially evenly spaced apertures along said hollow wall means.

30. The invention of claim 25 further comprising furniture means disposed on said hollow wall means.

31. The invention of claim 25 wherein said furniture means comprises furniture aperture means corresponding to said aperture means disposed in said hollow wall means.

32. The invention of claim 25 further comprising wall end intake aperture means and wall end exhaust aperture means.

33. The invention of claim 25 further comprising hollow wall coupling means.

34. The invention of claim 33 wherein said coupling means comprises septum means for separating filtered gas from unfiltered gas.

35. The invention of claim 33 comprising pluralities of hollow wall means and coupling means.

36. The invention of claim 35 wherein said pluralities of hollow wall means and coupling means have common air circulating means and filtering means.

37. A method of circulating and filtering gas using a modular divider system, the method comprising the steps of:

a) providing hollow wall means comprising a plurality of longitudinally disposed spaced aperture means;

b) filtering gas from the hollow wall means remote from the hollow wall means; and c) circulating gas from outside the hollow wall means, through the hollow wall means and to the filtering means, and to outside of the hollow wall means.

38. The method of claim 37 wherein the step of providing hollow wall means comprises the step of disposing a vented intake along a top of the hollow wall means.

39. The method of claim 37 wherein the step of providing hollow wall means comprises the step of disposing a vented base means along a bottom of the hollow wall means.

40. The method of claim 37 wherein the step of providing hollow wall means comprises the step of separating with an air impermeable septum means an air intake duct section of the hollow wall means from an exhaust duct section of the hollow wall means.

41. The method of claim 37 wherein the step of providing hollow wall means comprises the step of substantially evenly spacing the longitudinally disposed apertures along the hollow wall means.

42. The method of claim 37 comprising the further step of removably mounting furniture means on the hollow wall means.

43. The method of claim 42 wherein the step of mounting furniture means comprises the step of providing furniture aperture means in the furniture means, corresponding to aperture means disposed in hollow wall means.

44. The method of claim 37 comprising the further step of providing wall end intake aperture means and wall end exhaust aperture means.

45. The method of claim 37 comprising the further step of coupling with a rigid coupling means at least two hollow wall means.

46. The method of claim 45 wherein the step of coupling with a coupling means comprises the step of disposing in the coupling means a septum means for separating filtered gas from unfiltered gas.

47. The method of claim 45 wherein the step of coupling at least two hollow wall means comprises joining plurality of hollow wall means and coupling means.

48. The method of claim 47 wherein the step of joining pluralities of wall means and coupling means comprises the step of equipping the pluralities with a common air circulating means and a common filtering means.

49. A method of circulating and filtering gas using a modular divider system, the method comprising the steps of:

a) providing a plurality of rigid hollow wall means comprising gas receiving aperture means and gas exhausting aperture means;

b) filtering circulating gas from the rigid hollow wall means;

c) connecting a first portion of the plurality of rigid hollow wall means to the filtering means;

d) connecting a second portion of the plurality of rigid hollow wall means to the first portion of the plurality of rigid hollow wall means; and e) circulating gas from outside the rigid hollow wall means via the gas receiving aperture means, through the rigid hollow wall means and to the filtering means, and to outside of the rigid hollow wall means via the gas exhausting aperture means.

50. The method of claim 49 wherein the step of providing a plurality of rigid hollow wall means comprising gas receiving aperture means comprises the step of disposing along a top of the hollow wall means a vented intake.

51. The method of claim 49 wherein the step of providing a plurality of rigid hollow wall means comprising gas exhausting aperture means comprises the step of disposing along a bottom of the hollow wall means a vented base means.

52. The method of claim 49 wherein the step of providing a plurality of rigid hollow wall means comprises separating with an air impermeable septum an intake duct section of the hollow wall means from an exhaust duct section of the hollow wall means.

53. The method of claim 49 wherein the step of providing a plurality of rigid hollow wall means comprising gas receiving aperture means and gas exhausting aperture means comprises the step of longitudinally disposing the apertures at substantially regular intervals along the hollow wall means.

54. The method of claim 49 comprising the further step of mounting furniture means on the hollow wall means.

55. The method of claim 54 wherein the step of mounting furniture means comprises the step of providing furniture aperture means in the furniture means, corresponding to aperture means disposed in hollow wall means.

56. The method of claim 49 comprising the further step of providing wall end intake aperture means and wall end exhaust aperture means.

57. The method of claim 49 wherein the step of providing a plurality of rigid hollow wall means comprises disposing within the hollow wall means at least one horizontal structural member comprising perforations for allowing vertical flow of gas within the hollow wall means.

58. A method of circulating and filtering as using a modular divider system, the method comprising the steps of:

a) providing hollow wall means comprising gas receiving aperture means for receiving as from outside the hollow wall means, gas exhausting aperture means for exhausting gas to outside the hollow wall means, and at least one horizontal structural member disposed within the hollow wall means comprising a plurality of perforations for allowing vertical flow of gas within the hollow wall means;

b) filtering gas from the hollow wall means; and c) circulating gas from outside the hollow wall means via the gas receiving aperture means, through the hollow wall means and to the filtering means, and to outside of the hollow wall means via the gas exhausting aperture means.

59. The method of claim 58 wherein the step of providing hollow wall means comprising gas receiving aperture means comprises the step of disposing along a top of the hollow wall means a vented intake.

60. The method of claim 58 wherein the step of providing hollow wall means comprises the step of disposing a vented base means along a bottom of the hollow wall means.

61. The method of claim 58 wherein the step of providing hollow wall means comprises the step of separating with an air impermeable septum means an air intake duct section of the hollow wall means from an exhaust duct section of the hollow wall means.

62. The method of claim 58 wherein the step of providing hollow wall means comprises the step of substantially evenly spacing the longitudinally disposed apertures along the hollow wall means.

63. The method of claim 58 comprising the further step of removably mounting furniture means on the hollow wall means.

64. The method of claim 63 wherein the step of mounting furniture means comprises the step of providing furniture aperture means in the furniture means, corresponding to aperture means disposed in hollow wall means.

65. The method of claim 58 comprising the further step of providing wall end intake aperture means and wall end exhaust aperture means.

66. The method of claim 58 comprising the further step of coupling with a rigid coupling means at least two hollow wall means.

67. The method of claim 66 wherein the step of coupling with a coupling means comprises the step of disposing in the coupling means a septum means for separating filtered gas from unfiltered gas.

68. The method of claim 66 wherein the step of coupling with a coupling means at least two hollow wall means comprises joining pluralities of hollow wall means and coupling means.

69. The method of claim 68 wherein the step of joining pluralities of wall means and coupling means comprises the step of equipping the pluralities with a common air circulating means and a common filtering means.

* * * * *